US006481528B2

(12) United States Patent
Antonio

(10) Patent No.: US 6,481,528 B2
(45) Date of Patent: Nov. 19, 2002

(54) COMBINATION UTILITY BELT AND CLIMBING HARNESS

(76) Inventor: Ishmael L. Antonio, 4804 Juneau Hills Dr., Rio Rancho, NM (US) 87124

( * ) Notice: Subject to any disclaimer, the term of this patent is extended or adjusted under 35 U.S.C. 154(b) by 0 days.

(21) Appl. No.: 09/741,475

(22) Filed: Dec. 19, 2000

(65) Prior Publication Data

US 2001/0047904 A1 Dec. 6, 2001

Related U.S. Application Data

(60) Provisional application No. 60/171,676, filed on Dec. 21, 1999.

(51) Int. Cl.[7] ..... A62B 35/00
(52) U.S. Cl. ..... 182/6; 182/3; 224/240
(58) Field of Search ..... 182/3, 6, 7; 2/311, 2/312, 319, 321, 322; 224/240

(56) References Cited

U.S. PATENT DOCUMENTS

| | | | | |
|---|---|---|---|---|
| 1,279,753 A | * | 9/1918 | Paymer | |
| 3,424,134 A | | 1/1969 | Rosenblum | 119/96 |
| 3,797,715 A | | 3/1974 | Scialdone | 224/2 B |
| 3,866,276 A | * | 2/1975 | Perkins | |
| 4,106,121 A | | 8/1978 | Belson | 2/102 |
| 4,788,941 A | | 12/1988 | Villeneuve | 119/96 |
| 5,228,412 A | | 7/1993 | Bell | 119/96 |
| 5,413,262 A | * | 5/1995 | Dewire et al. | |
| 5,464,136 A | * | 11/1995 | Eddy | |
| D384,810 S | * | 10/1997 | Kopel | |
| 5,927,574 A | | 7/1999 | Ruesink | 224/149 |
| 5,988,315 A | | 11/1999 | Crane | 182/3 |
| 6,050,364 A | | 4/2000 | Popall et al. | 182/6 |
| 6,189,651 B1 | * | 2/2001 | Sadeck | 182/6 |
| D447,864 S | * | 9/2001 | Casparian | |

FOREIGN PATENT DOCUMENTS

| | | |
|---|---|---|
| GB | 2 115 684 A | 9/1983 |
| GB | 2 191 560 A | 12/1987 |
| GB | 2 255 622 A | 11/1992 |

* cited by examiner

*Primary Examiner*—Alvin Chin-Shue
(74) *Attorney, Agent, or Firm*—Rod D. Baker

(57) ABSTRACT

A dual belt system having a load-bearing or "utility" belt as well as a climbing harness waist band. An inner belt is a waistband for a climbing harness, the other outer belt being any typical load bearing belt, such as a military gear belt. The inner harness waistband and the load bearing belt are connected together by a series of releasable loops upon the waistband that may be opened to allow the load bearing belt to be separated from the harness. The loops may be closed and secured, as by fasteners, around a load bearing belt to temporarily connect together the harness waistband and the load bearing belt, so that they functional as an integral unit. Also provided are leg loops, permanently attached to the waistband of the harness, with which a true pelvis-girdling climbing harness may be assembled. The leg loops are stowed in a special pouch on the waistband until such time as they are deployed for use.

8 Claims, 17 Drawing Sheets

COMBINATION UTILITY BELT AND CLIMBING HARNESS

This application claims the benefit of provisional application No. 60/171,676 filed Dec. 21 1999.

BACKGROUND OF THE INVENTION

1. Field of the Invention (Technical Field)

The present invention relates to an integrated load bearing belt and a climbing harness, such as a harness used to rappel from a building, cliff, helicopter, or the like.

2. Background Art

To conduct high angle (steep climb and down rappel) urban operations, include assaults or rescues in buildings, climbers have to wear both a load bearing "utility" or tool belt as well as a climbing harness that has fixed leg loops. Similar requirements arise in the event of assaults, searches, and rescues on cliffs or steep mountainous terrain. The load bearing belt is used to carry and support the gear and tools the user requires for the particular operation. In the case of a rescue operation, for example, the load bearing belt carries paramedic supplies. In the circumstance of an assault by military or law enforcement personnel, the load bearing belt may bear a firearm and/or nightstick, and/or other weapons and defensive gear, as well as a first aid kit or the like.

In order to perform high angle maneuvers using climbing ropes, the user must also be equipped with some sort of climbing harness wherewith the user is removably and controllably connected to the climbing rope or ropes deployed in the operation. If a climbing harness is not available, users typically use a "Swiss seat" (webbing or rope to form a makeshift harness) or they use a rappel belt. The use of either a Swiss seat or a rappel belt can be very uncomfortable and dangerous. Ideally, to simplify use and improve efficiency and comfort, a system would be provided for combining the load bearing belt and climbing harness into an integrated system.

Rappelling or hanging from a rappel belt (hanging from single point) can cause serious life-threatening injuries. A rappel belt is worn around the waist with a V-ring located at the front of the belt as the single rappel point. Hanging free or repelling on a single point on one's waist, without the use of leg loops, forces all the weight on the lower back. When only a rappel belt is used to secure the climber, a dynamic fall can produce unacceptable forces on the body. Forces greater than 8 G (8 times body weight) will inflict serious life-threatening injuries to the user's back and internal organs. The rappel belt can also ride high up and over the rib cage to the user's diaphragm, constricting breathing. Further, a rappel belt increases the difficulty of performing various operations, due to the inherent twisting motion of the user's body while attached only to one line at a single point. Hanging from a rappel belt is also very uncomfortable.

The Swiss seat is an improvised seat harness made by the user from available webbing or rope. To properly tie the Swiss seat, it must be flush against the body, thus requiring the user to remove all other equipment from around the waist. A Swiss seat also takes time and skill to construct, which may not be available at the moment of need in a rescue or assault operation. A makeshift Swiss seat harness is generally constructed from narrow 11 mm rope or 1-inch webbing. These type of materials cut into the user's legs and waist making long-term hanging or repelling from a Swiss seat very uncomfortable.

Additionally, there are a number safety issues associated with most currently available climbing harnesses. Known harnesses typically have fixed leg loops, i.e., leg loops that cannot be stored. When a user is wearing a climbing harness but has no immediate need for it, such as when the user is repelling, climbing, or hanging on a hoist, the dangling, exposed leg loops can get snagged unexpectedly, causing a dangerous operational situation. Moreover, when a user has no immediate need for a climbing harness, but nevertheless wears one for the sake of preparedness, it is uncomfortable to have leg loops on for extended periods of time, e.g., one hour or more.

The need for a dependable harness is evident when, for example, during helicopter FAST rope insertion, the fixed leg loops of a standard climbing harness snag on a part of the helicopter, causing the user to hang upside down beneath the belly of a flying helicopter. As a result of incidents such as this and other recognized deficiencies in the standard climbing harness, the present invention was developed to satisfy the special needs of tactical, rescue, and medical missions.

Examples of belt and/or harness type devices known in the art include:

U.S. Pat. No. 3,424,134 to Rosenblum;

U.S. Pat. No. 3,797,715 to Scialdone;

U.S. Pat. No. 4,788,941 to Villeneuve;

U.S. Pat. No. 5,228,412 to Bell;

U.S. Pat. No. 5,927,574 to Ruesink;

U.S. Pat. No. 5,988,315 to Crane; and

U.S. Pat. No. 6,050,364 to Popall et al.

In addition, United Kingdom patent publications GB 2,115,684A (September. 1983), GB 2,191,560A ((December 1987), and GB 2,255,622A (November 1992) disclose certain features of belt and harness devices known in the art. All the foregoing references are hereby incorporated herein by reference.

At present, there is no integrated load bearing belt and climbing harness available that can perform both the equipment support function and the climbing function required in many tactical operations. Against this background, the present invention was developed.

SUMMARY OF THE INVENTION (DISCLOSURE OF THE INVENTION)

The inventive apparatus comprises a novel designed load bearing harness with specially tailored stow-away leg loops. The versatility of the invention enables it to have unlimited mission capabilities. This harness is designed for users such as SWAT teams, law enforcement, military personnel, emergency medical rescue teams, and the like. Users of the invention benefit from the security of being equipped with a load bearing belt to support operational equipment, as well as a climbing harness on demand. Such operational environments may include operating within elevator shafts and other enclosed spaces, or ascending and descending from high-rise structures or cliffs. Other operational situations may include rapid transition from ground rescue to aerial rescue and vice versa, or safe, quick, and comfortable emergency hoist extraction.

The invention also offers the capability of incorporating or attaching special accessories to enhance its mission function. For example, a tactical accessory pouch, which attaches to the inventive harness apparatus, has many functions. It can serve as an airway pouch for tactical medics, thus providing quick access to provisions to treat emergency airway injuries. The pouch, even when open, retains items in place in their internal pouches and it has the capability to be closed quickly using a Velcro® strap.

Also included as a feature of the invention is a personal tie-down strap, equipped with a quick-release system, specially designed to allow users to secure themselves to an object by connecting a flexible tie down strap between the inventive harness and the anchoring object. For example, the tie-down strap can be used on aircraft, vehicles, and boats when it is necessary for the user to anchor himself for safety. The inventive combination of the harness, tactical accessory pouch, and the personal tie-down strap combine to form the integrated system of the complete inventive apparatus.

The invention integrates a safe, strong, well-fitted, comfortable, convenient, and not too complex climbing harness with a specifically designed load-bearing belt. The inventive harness serves the same purpose as a sit harness, seat harness, or a thigh-loop harness. The harness comprises an adjustable, padded, wide nylon-webbing waistband that is secured to the user's body with a climbing buckle. The harness also includes two adjustable wide flat-webbing leg loops fixed on one side of the waistband that are stored easily in a small, readily accessible pouch. The padded waistband has belt loops on the outside that integrates a rigid two-layer SCUBA belt webbing with a quick-on/quick-off buckle that will not twist or sag like typical nylon waist webbing. The SCUBA belt webbing is a load bearing belt, designed to easily carry essential first line equipment such as, a holster, magazine pouch, radio pouch, thigh pouch, gas mask, accessory pouch, or the like. The invention is designed to incorporate most if not all of these features.

There is provided according to the invention in combination with a load bearing belt upon which various equipment may be disposed, a harness comprising a waistband, a plurality of connecting loops upon said waistband, said connecting loops movable between an open position to permit said load bearing belt to be disposed in parallel contact with said waistband and a closed position around said load bearing belt, and fasteners upon said connecting loops whereby said connecting loops may be fastened in the closed position thereby to maintain said waistband and said load bearing belt in generally parallel contact during use. Preferably the harness further comprises a leg loop pouch attached to said waistband, and leg loops attached to said waist band, wherein said leg loops are movable between a stowed position completely within said leg loop pouch and a deployed position completely outside said leg loop pouch.

Alternatively characterized, the invention is a combination load bearing belt and climbing harness apparatus, said apparatus comprising a load bearing belt upon which items may be temporarily carried, a harness waistband disposable in parallel contact with said load bearing belt, and a plurality of connecting loops disposed upon said harness waistband and movable between an open position and a closed position said connecting loops having fasteners thereon to permit said connecting loops to be fastened in the closed position, wherein said connecting loops are movable to the open position to permit the load bearing belt to be placed in contact with said harness waistband, and are movable to the closed position around said load bearing belt temporarily but securely to hold together as a unit said load bearing belt and said harness waistband. In this embodiment, the load bearing belt further comprises a quick-release buckle with which said load bearing buckle may be secured about a user's waist. The harness waistband is movable between a stowed position and a use position, and further comprises a releasable loop for holding a first end of said waistband in a folded condition adjacent to said load bearing belt when said waistband is in the stowed potion, and further comprising a climbing buckle upon a second end of said waistband, wherein said first and an said second end of said waistband are connectable together with said climbing buckle when said waistband is in the use position. Advantageously, the harness waistband is disposable in the stowed position while said load bearing belt is secured about a user's waist, or the harness waistband is disposable in the use position, with said first end connected to said second end by means of said climbing buckle, while said load bearing belt is secured about a user's waist. Preferably, the harness further comprises a leg loop pouch attached to said waistband, and leg loops permanently attached to said waistband, wherein said leg loops are movable between a stowed position completely within said leg loop pouch and a deployed position completely outside said leg loop pouch.

An additional advantageous feature of the invention is a tactical thigh pouch removably attachable to said load bearing belt. The tactical thigh pouch comprises a pouch container, said container comprising a front portion and a back portion, said portions separable to place said container in an open position to permit access to the interior of said container, fasteners for releasably fastening together said front and back portions of said container in a closed position, a looped attachment strap upon said container for removably attaching said container to said load bearing belt, a hook strap stowable upon said looped attachment strap, complementary fasteners upon said hook strap and upon said front portion of said container, wherein said container may be maintained in the closed position by deploying said hook strap from said looped attachment strap and engaging said complementary fasteners.

A primary object of the present invention is to provide a tactical climbing harness, including leg loops, that can be comfortably and safely stowed on and beneath an ordinary load bearing belt when not in use, but yet which is easily and rapidly deployable when needed.

A primary advantage of the present invention is that a load bearing belt and a climbing harness may be temporarily integrated as a single unit, with the harness being available for use at all times without interfering with the use of the load bearing belt.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS BEST MODES FOR CARRYING OUT THE INVENTION

Broadly described, the apparatus of the invention is a dual belt system; one inner belt being a waistband for a climbing harness, the other outer belt being any typical load bearing belt, such as a military or policy gear belt. The inner harness waistband and the load bearing belt are connected together by a series of releasable loops upon the harness waistband that may be opened to allow the load bearing belt to be separated from the harness. The loops may be closed and secured, as by snaps or VELCRO® fasteners or the like, around a load bearing belt to temporarily connect together the harness waistband and the load bearing belt, so that they functional as an integral unit. Also provided are leg loops, permanently attached to the waistband of the harness, with which a true pelvis-girdling climbing harness may be assembled. The leg loops are stowed in a special pouch on the waistband until such time as they are deployed for use.

The invention's unique integration of a load-bearing belt with a climbing harness allows for multiple uses. The load-bearing belt can be worn without buckling the climbing buckle on the harness waistband. The climbing buckle is stowed comfortably behind the load-bearing belt when not in use, creating an independent system. The load-bearing belt is a simple stand-alone system that enables the user to perform routine duties without the climbing harness getting in the way. The invention can also be used as a simple waist tie down point for the user by securing the climbing buckle on the harness waistband to an anchor point. Accessibility to the waist tie down point is quick, convenient, and permits complete freedom of movement when the leg loops are not required.

By securing the climbing buckle on the harness and utilizing the two adjustable leg loops (from the easily accessible pouch) the inventive apparatus can be converted into a true climbing harness that is worn around the pelvic girdle. The invention is configured for use with a climbing rope, or with descending or ascending devices. The invention is easily donned, comfortable, non-restrictive. After a fall, and in contrast with a common rappel belt in combination with a load-bearing belt, the inventive apparatus distributes the gravitational forces attributable to the fall to the thighs and buttocks—not just the lower spine. The invention can function with all the benefits of a climbing harness, i.e., to hang free, to hang up-side down or sideways, for climbing, to belay other climbers, etc. The versatility of the invention enables the user to have unlimited mission capabilities with a single integrated system. Users employing the inventive system will have the security of being equipped full time with both a load-bearing belt and a climbing harness that is available on demand.

Figure 1A:
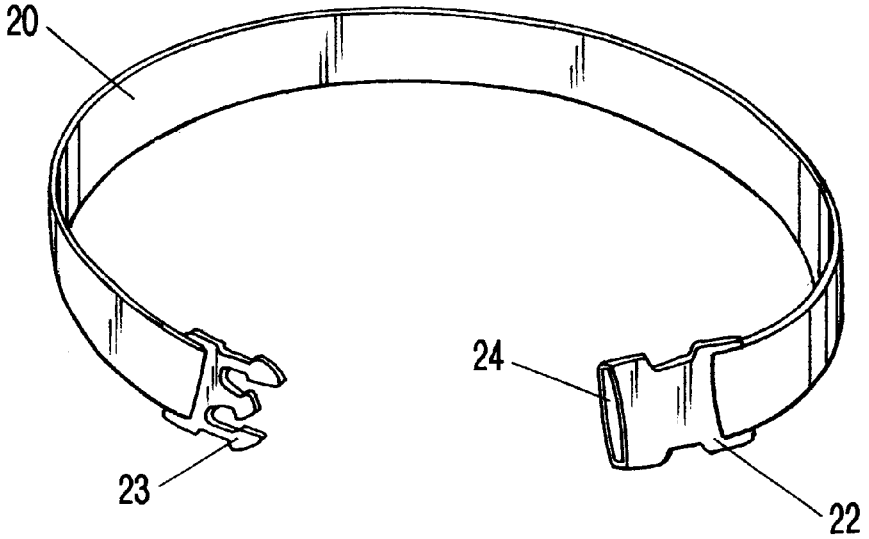
FIG-1A PRIOR ART
FIG. 1A is a front perspective view of a conventional load bearing belt known in the art.
Figure 1B:
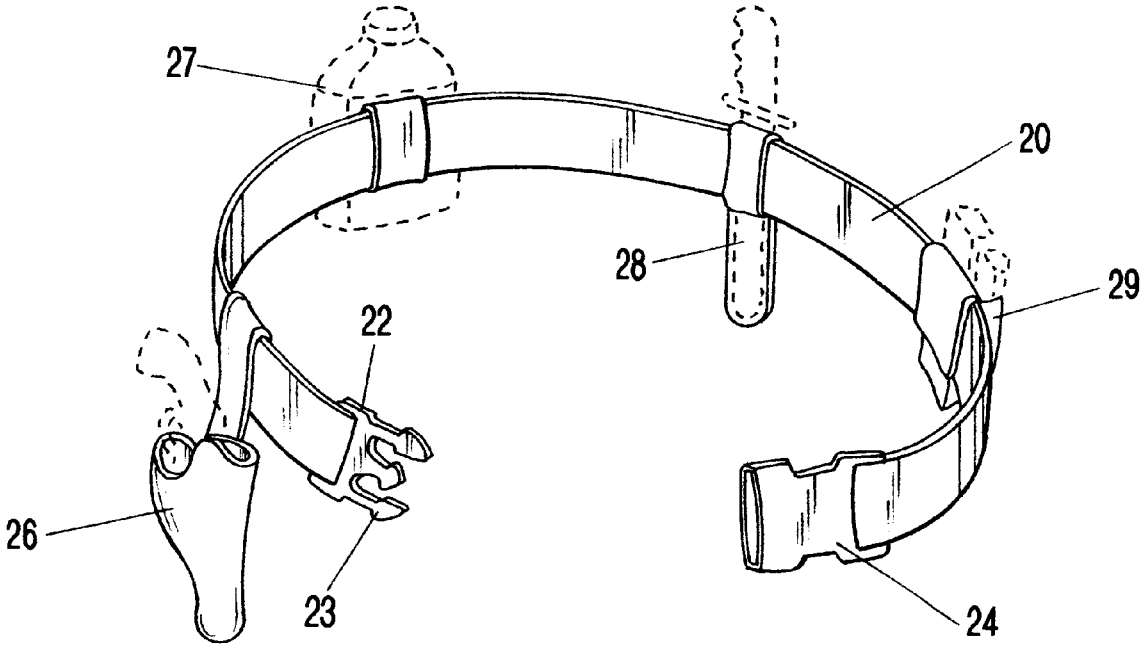
FIG-1B PRIOR ART
FIG. 1B is a front perspective view of a conventional load bearing belt seen in FIG. 1, with various typical utility items and tools removably disposed thereon.

Attention is invited to FIGS. 1A and 1B, showing a utility or load bearing belt 20 of the prior art. An advantage of the present invention is that it is a combination of practically any known load bearing belt 20 with the other elements of the invention, so that the invention is remarkably versatile. The load bearing belt 20 can be practically any type of load bearing belt known; the invention is particularly well-suited to include the woven fabric belts commonly employed in the military (i.e. which contain uniformly disposed holes for the mounting of gear and tools thereon using standardized clips). In the preferred embodiment, the load bearing belt 20 has a "quick clip" type of buckle 22 of known construction. Quick clip buckle 22, available off-the-shelf, is fashioned from durable resilient plastic, and is adapted for quick engagement by the insertion of the male clip portion 23 into the female housing portion 24. Elastically flexible exterior prongs clip portion 23 first bend inward, and then rebound into corresponding slotted recesses within the housing portion to securely attach the ends of the belt 20 together. Despite the secure and reliable attachment accomplished by the buckle 22, the buckle may be quickly disengaged by depressing the exterior prongs of the clip portion to release the ends of the belt 20 from one another.

In the practice of the invention, the load bearing belt 20 is used to carry practically any desired tools, kits, or weapons according to convention. For example, as seen in FIG. 1B, the load bearing belt 20 mounts a handgun holster 26, a small canteen 27, a sheathed knife 28, and a ammunition magazine pouch 29. As will become further evident, the invention permits the user to have at his disposal these various tools and equipment, while yet also being able to use the climbing harness according to the invention.

Figure 6:
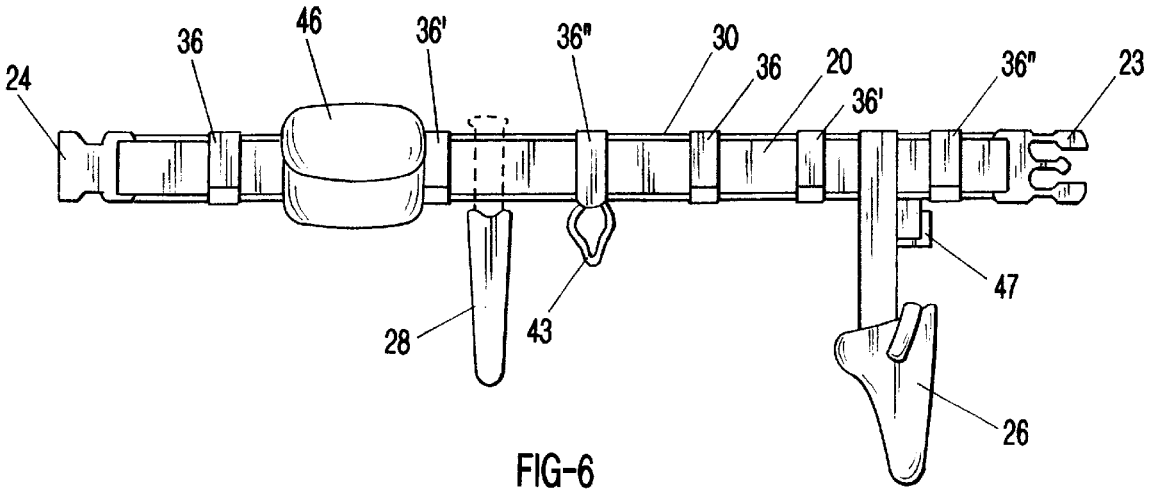
FIG. 6 is a side or outside view of the complete apparatus of the invention, showing a load-bearing belt removably connected to the waistband of the specialized harness by belt loops on the waistband.
Figure 7:
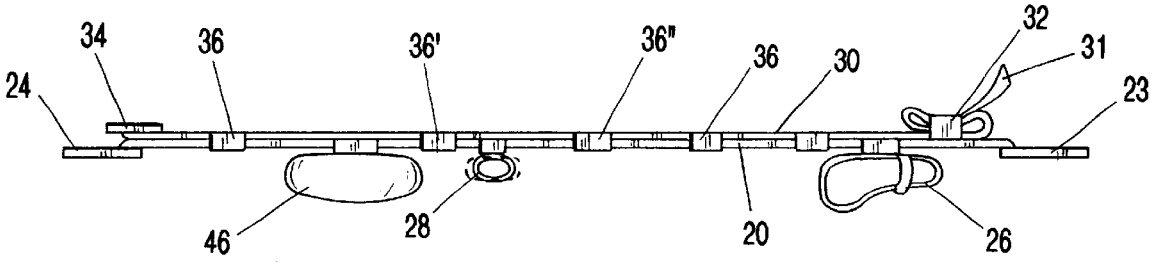
FIG. 7 is a top edge view of the apparatus depicted in FIG. 6.
Figure 8:
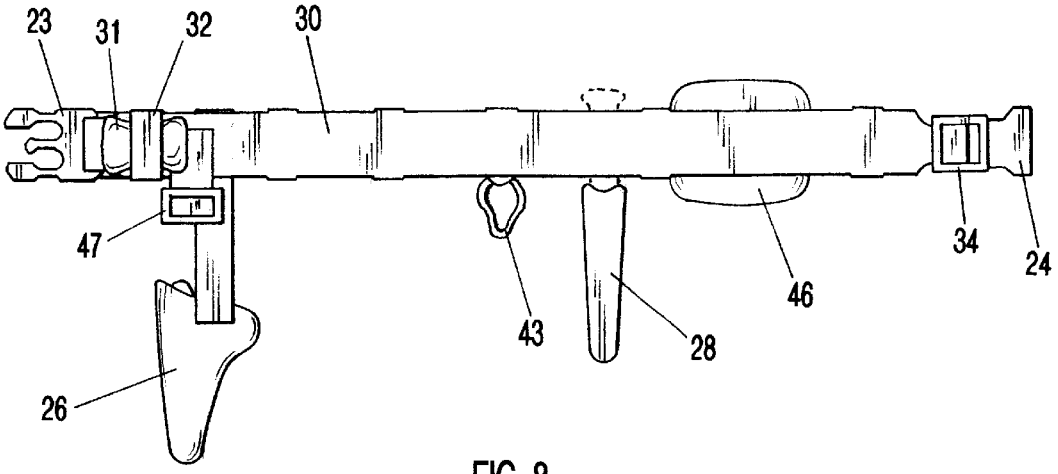
FIG. 8 a view of the other side or inside view of the complete apparatus than that shown in FIG. 6, showing surface of the waistband of the specialized harness that would be placed against the user's body during the use.

FIGS. 6–8 show the load bearing belt 20 in combination with the harness elements of the invention, including the waistband 30. According to the invention, the waistband 30 of the harness is disposed upon the user's body, but in a stowed condition. FIG. 6 shows the apparatus of the invention in a position ready to be placed upon the user's body. The harness waistband 30 preferably but not necessarily is wider throughout most its length than the load bearing belt 20. When the apparatus of the invention initially is placed upon the user's body, the harness waistband 30 is between the load bearing belt 20 and the body, i.e., the load bearing belt is on the "outside" and the harness waistband 30 is on the "inside" radially in relation to the user's waist. FIG. 6 shows the "outside" of the combination apparatus; the user secures it upon his body by simply encircling his waist and then engaging the clip portion 23 into the female housing portion 24 of the quick click buckle 22. Referring to FIG. 8, the "inside" view of the apparatus, it is seen that the broad length of the climbing harness waistband 30 situates to serve as a comfortable barrier between the load bearing belt (only the clip buckle 22 of which is visible in the figure) with its tools and weapons 26–29, and the user's body. Only the neatly folded narrow working end 31 of the harness waistband need come between the broad waistband 30 and the user's body.

When the invention is first placed upon the body, the user ordinarily will wish to have access to his belt-mounted tools 26–29. When the invention is properly used, nothing about the placing of the load bearing belt 20 about his waist compromises the user's ability to readily access his firearm, canteen, magazine pouch, knife, or the like. An advantage of the invention over prior art devices is that existing harness waistbands, when used with or as belts for carrying tools or equipment, tend to roll or collapse under climbing weights at the points where tools are attached—resulting in discomfort to the user. The present invention reduces or eliminates the tendency for belts to roll.

A distinct advantage of the invention is that the harness waistband 30 is tucked or stowed away until actually needed at the time of a climbing/rappelling maneuver. Reference to FIGS. 7 and 8 show that when not in use, the harness waistband 30 may be wrapped around the user's waist, except that the working end 31 is foreshortened by being multiply folded and temporarily retained within a releasable loop 32. The releasable loop 32 may be a pair of narrow strips with, for example, complementary sections of VELCRO® fabric fasteners or other releasable fasteners, or may be a single closed loop of elastic fabric, or the like. Accordingly, the working end 31 of the harness waistband 30 is tucked innocuously away until deployed to operate the harness. The opposite end of the harness waistband 30 features a standard climbing buckle 34 permanently attached thereto. Thus, when occasion requires that the harness waistband 30 be fixed completely around the user's waist, the working end 31 of the waistband is passed over and through the climbing buckle 34, and the climbing buckle engaged according to convention.

Figure 2:
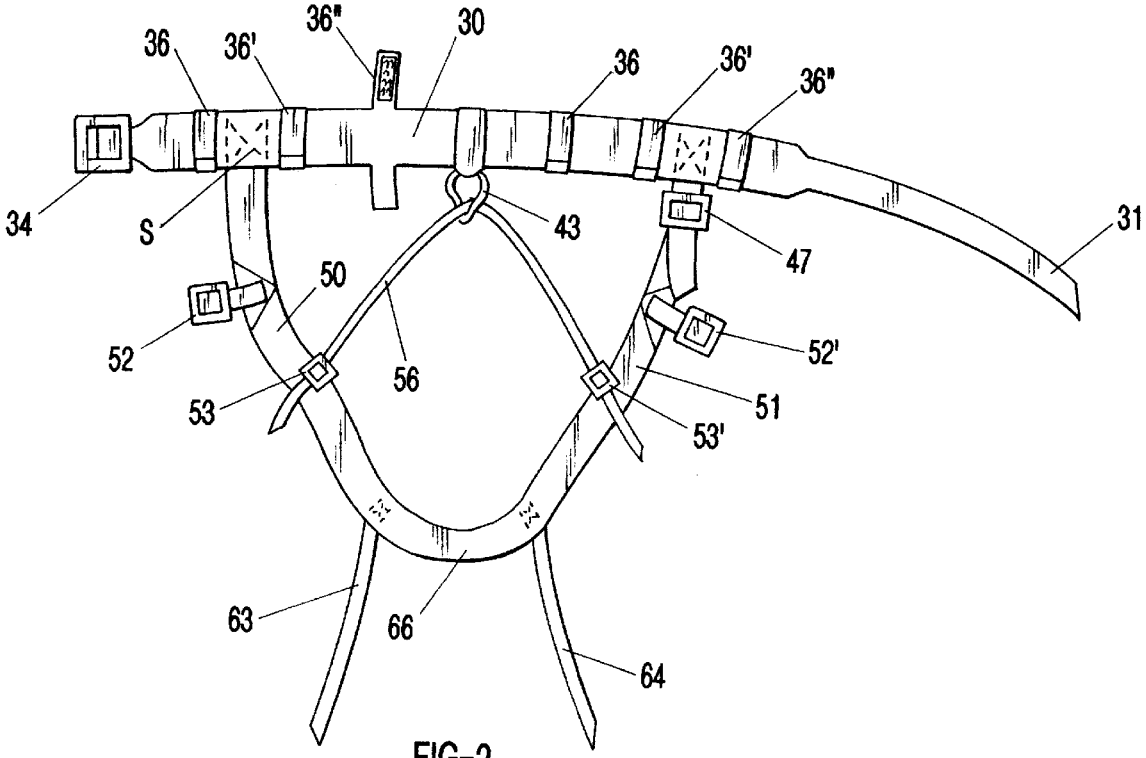
FIG. 2 is a rear view of the specialized harness of the present invention partially configured for use but with the leg loops open.

FIGS. 6 and 7 also offer views of the means of temporarily attaching parallel together the load bearing belt 20 and the harness waistband 30. There are provided upon the waistband 30 a plurality of generally (but not necessarily) uniformly spaced connector loops 36, 36', 36". The connector loops 36, 36', 36" are a series of small one- or -two-piece durable (e.g. canvas) straps that may be opened or closed, and when in the closed position define closed loops which encircle and fold the load bearing belt 20. (FIG. 2 depicts a single one of the connector loops 36 in an open condition.) The connector loops 36, 36', 36" mount complementary pieces of VELCRO® fabric fasteners, snaps, or other reliable but releasable fasteners (seen at 37, 37' in FIG. 2). When in use, the apparatus of the invention is a single dual-belt unit, whereby the load bearing belt 20 is maintained snugly against and parallel to the harness waistband 30 by the action of the connector loops 36, 36', 36'. The user connects the load bearing belt 20 to the waistband 30 by first opening all the connector loops 36, 36', 36", disposing the load bearing belt upon and against the waistband 30, wrapping the connector loops 36, 36', 36", around the load bearing belt 20, and closing them with the VELCRO or other fasteners to temporarily secure the waistband and load bearing belt together as a unit. Notably, the user may interchange any of a variety of different load bearing belts, as preference or mission may indicate, by the simple expedient of opening and closing the connector loops 36, 36', 36" to facilitate removable and replacement of different load bearing belts.

Figure 9:
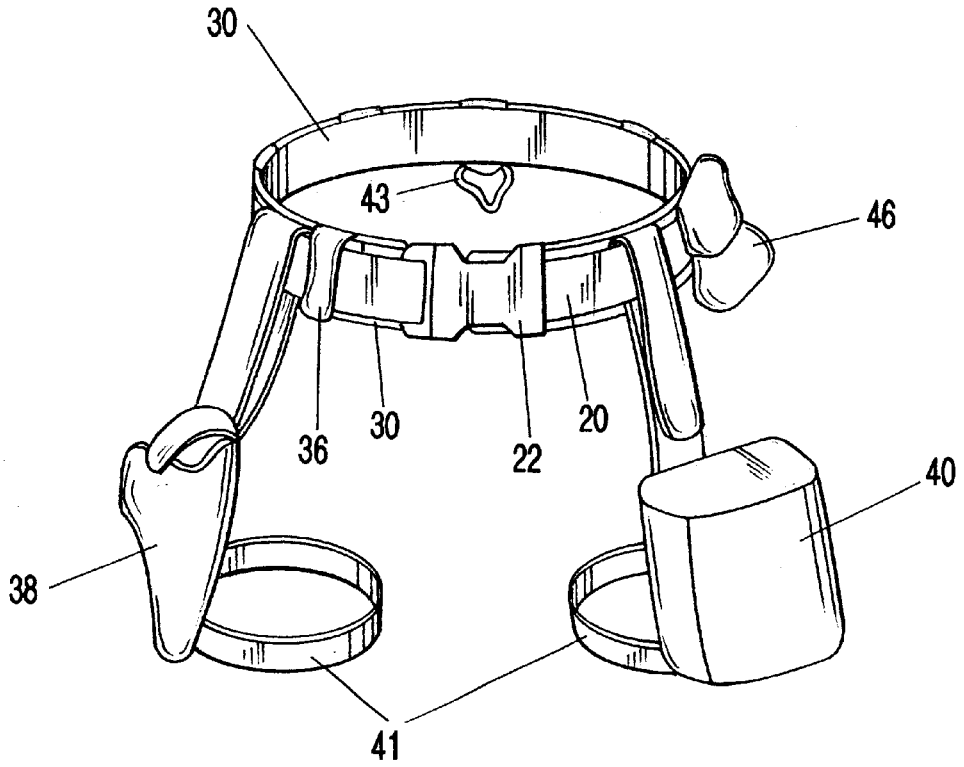
FIG. 9 is a front view of the apparatus of the invention as it would appear while being worn by a user a load-bearing belt only, with the specialized harness being fully stowed.
Figure 10:
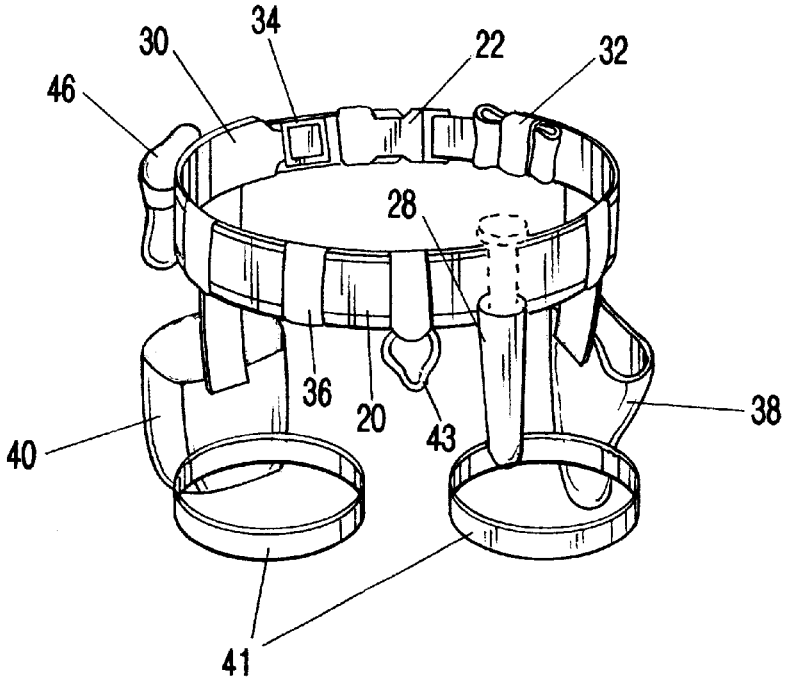
FIG. 10 is a rear view of the apparatus depicted in FIG. 9.

FIGS. 9 and 10 usefully depict how the complete apparatus of the invention might appear at the outset of a tactical mission, when the load bearing belt 20 is in position around the user's waist, but with the harness waistband 30 stowed out of the way until needed. The clip buckle 22 holds the load bearing belt 20 in place. The invention optionally include a major tool or handgun holster 38 that has a loop or clip attachment to the load bearing belt 20. There is also seen a tactical thigh pouch 40, to be described in further detail, for holding at the ready a first aid kit or the like. A holster 38 and a tactical thigh pouch 40 preferably are equipped with loop loops 41 for holding them firmly against the user's upper thigh, preventing them from flapping about or snagging on surrounding items. FIG. 10, the rear view, shows the working end 31 of the harness waistband 30 tucked away in the releasable loop 32, and the waistband's climbing buckle 34 presently unused but at the ready. The medial rear portion of the waistband 30 has a rigid, e.g. stainless steel, loop 43 permanently secured to and hanging down therefrom. The loop 43 is used in the rigging of the harness' leg loops for use, as shall shortly be described. At the outset of the use of the invention, and advantageously, the harness' leg loops (not seen in FIGS. 9 and 10, are safely and unobtrusively stored in the leg loop pouch 46 removably but reliably attached either upon the load bearing belt 20 or upon the harness waistband 30. The leg loop pouch 46 preferably is connected to the upper edge of harness waistband 30, and then "hooked" or placed over the load bearing belt 20, i.e. so the load bearing belt is situated between the harness waistband and the leg loop pouch.

Figure 5:
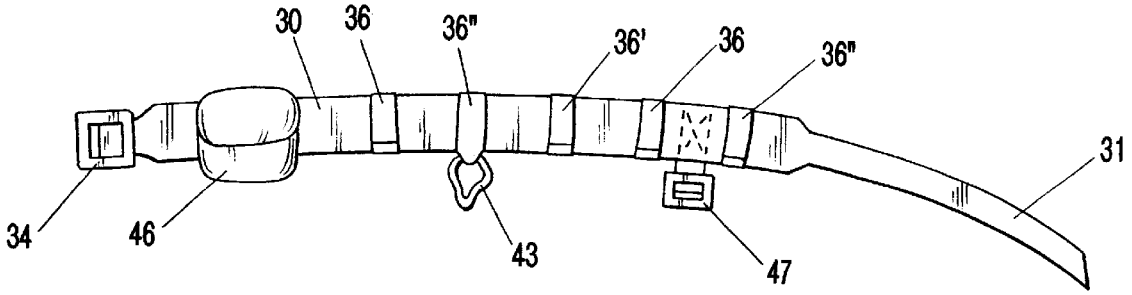
FIG. 5 is a diagram of the specialized harness, showing the pouch thereon in which the leg loops are stowed when not in use.

FIG. 5 is a diagram, somewhat reduced in scale, depicting the overall "outside" appearance of the harness waistband 30. The harness waistband features the ordinary climbing buckle 34 used to engage the ends of the waistband together when the waistband fully encircles the user's waist during use. The connecting loops 36, 36', 36" are shown, in a closed position, but which may be opened and re-closed to attach the load bearing belt 20 (not seen in FIG. 5) to the harness waistband. The harness leg loops are stowed in the leg loop pouch 46 on. the waistband 30. A leg loop attachment buckle 47 is permanently sewn or otherwise reliably secured to the waistband 30. The leg loop attachment buckle 47 is utilized in the rigging of the harness leg loops during tactical missions. The connecting loops 36, 36', 36" are movable from an open position to admit placement of the load bearing belt 20 in parallel contact with the waistband 30, to a closed position to maintain the waistband and load bearing belt in parallel contact and as an integral unit. The connecting loops 36, 36', 36" preferably are each equipped with a pair of complementary fasteners, such as snaps or VELCRO or the like, to secure them in the closed position enclosing the load bearing belt 20. Notably, the user need not use all the connecting loops 36, 36', 36" at a given time. Some or all may be used; the user may pick and choose among the several connecting loops 36, 36', 36" in order to hold the belt 20 and the waistband 30 together, taking account of the possibility, for example, of not using a particular one of the connecting loops to allow an item of gear to hang at that point instead.

Figure 3:
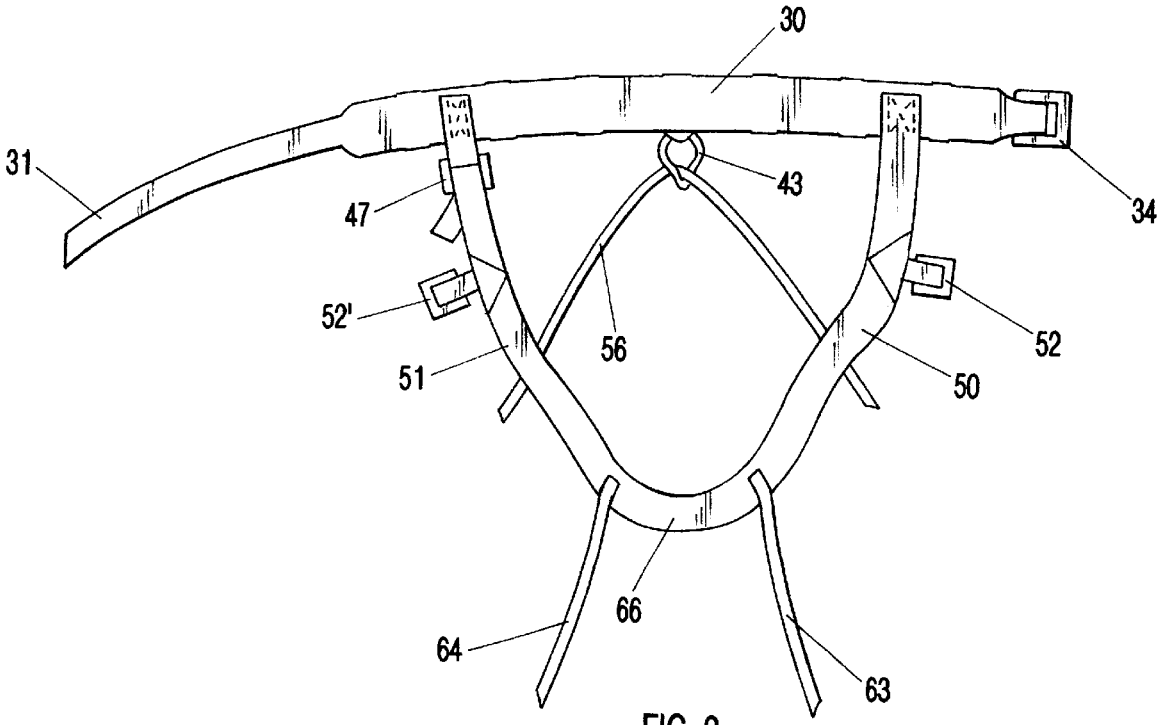
FIG. 3 is a front view of the harness shown in FIG. 2.
Figure 4:
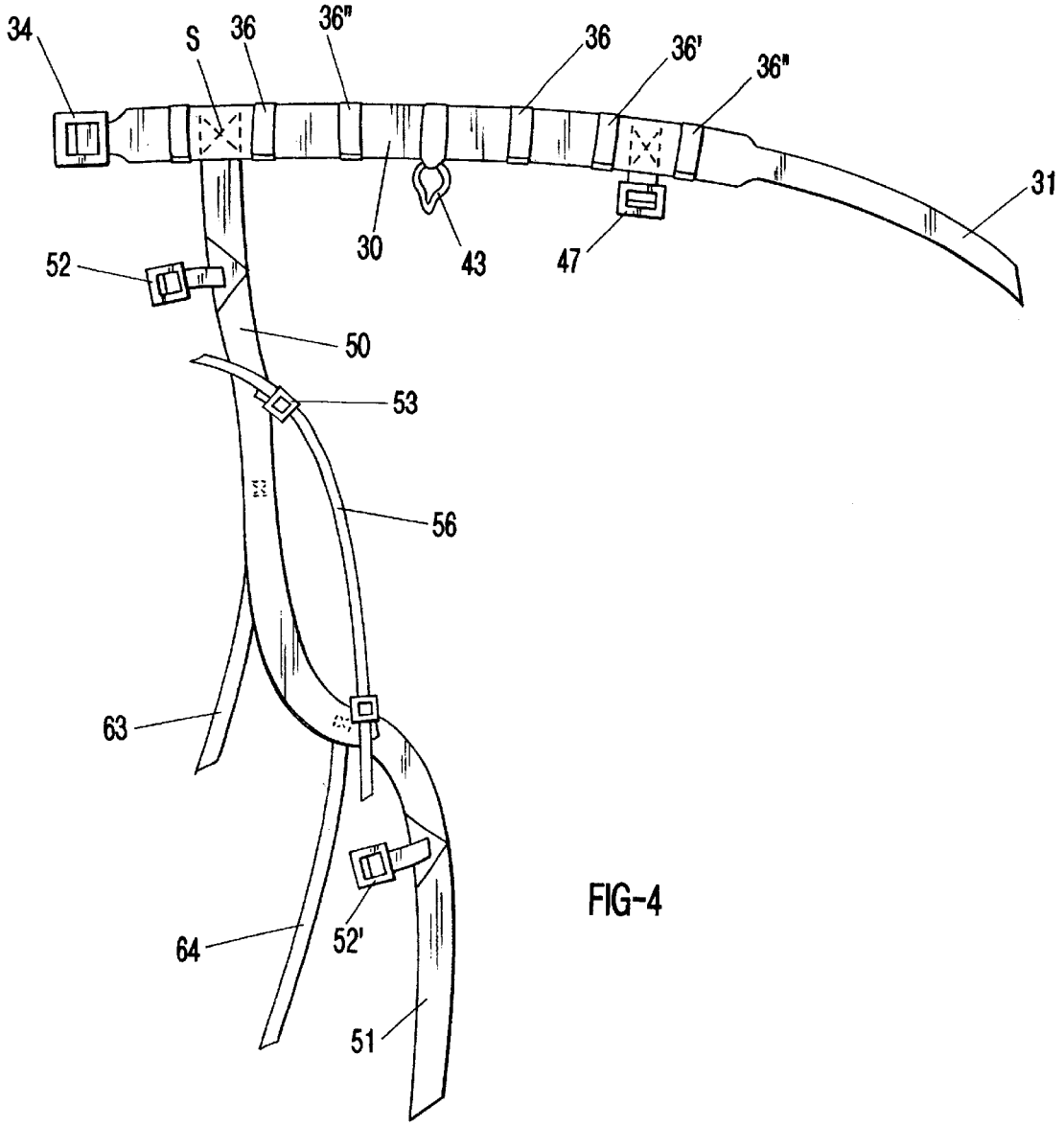
FIG. 4 is a partial side view of the specialized harness according to the present invention, showing the leg loops mostly detached from the harness waistband.

FIGS. 2–4 depict the entire climbing harness portion of the apparatus of the invention. The complete harness is fashioned from woven nylon "webbing" or straps, customary in the climbing and rappelling arts, so to be durable, abrasion- and cut-resistant, and able to withstand the tremendous stresses and strains commonly encountered in climbing gear in use. The complete harness includes the harness waistband 30, as well as the pair of leg loops 50, 51 which are wrapped around the user's buttocks and upper thighs to provide a reliable, relatively comfortable, and above all safe, pelvic cradle for the user. As seen in FIGS. 2–4, the leg loops 50, 51 are an assembly of interconnected straps adapted to be wrapped around the user's thighs in a particular manner to be described, and secured using a plurality of climbing grade leg loop buckles 52, 52'and 53, 53'. FIG. 4 illustrates the leg loops 50, 51 as they appear in their loosest configuration, immediately after having been pulled from storage in the leg loop pouch 46.

The leg loops 50, 51 are connected to the waistband 30 at three locations: One leg loop 50 is permanently sewn to the band at permanent attachment point S, and very reliably but releasably secured to the other side of the waistband 30 by leg loop attachment buckle 47. Also, an auxiliary strap 56 is passed through the harness loop 43. The ends of the auxiliary strap 56 are adjustably connected to the main leg loop strap by means of the outer leg loop buckles 53. Other attachments of the leg loops 50, 51 are provided as well, not seen in FIGS. 2–4 but to be described shortly.

The steps involved in using the apparatus of the invention, and exploiting its advantages, may now be described. The apparatus may be used in three different, but increasingly sophisticated configurations. In the first and simplest configuration, the apparatus is used solely as a load bearing belt. In this configuration, the climbing harness is present, but in its stowed condition so as not to interfere with tactical operations, access to the tools and weapons upon the load bearing belt, and the like. Yet, in the simplest configuration, the user has the confidence of knowing that the climbing harness (with or without the leg loops), is readily available for use with only a few seconds of activity. In the second or intermediate configuration, the harness waistband is deployed, but without the leg loops. The waistband can then be used, for example, to safely and "tie off" the user to a secure anchor point during intensive tactical operations, high winds, extreme rescue or sharpshooting circumstances, or the like. Finally, in the intensive third phase or configuration, the leg loops of the harness also are deployed and rigged about the user's pelvic area, to enable full-scale rappelling and other intensive tactical entry and/or rescue operations, etc, where the user must avail himself of the security and safety of a complete climbing harness.

In FIGS. 9 and 10, the apparatus of the invention is shown in the simplest configuration. The load bearing belt 20 is connected around the user's waist, and supports any of a variety of selected tools, weapons, gear, and the like, such as the major holster 38, a tactical thigh pouch 40, and sheathed knife 28. The load bearing belt is secured in place by the quick-clip buckle 22, and supports all the gear mounted thereon in a conventional manner, where it can be accessed and used. An advantage of the invention, however, is that the harness waistband 30 is already mostly in place around the user's waist; its working end 31, which would otherwise have to be either uncomfortably secured to the harness climbing buckle 34 or left to flap hazardously about. When needed, the harness waistband 30 can be quickly accessed and deployed—importantly without having first to completely remove the load bearing belt 20, and then replace it after securing the waistband 30 in place. The leg loops, not seen in FIGS. 9 and 10, are stowed in the leg loop pouch 46. As configured in FIGS. 9 and 10, the apparatus of the invention can be worn comfortably for extended periods of time (with or without the gear loops 41 in place around the thighs. A harness waistband 30, in contrast, is comparatively uncomfortable to wear for long periods of time; yet it is desirable to have a harness ready for use when needed, a need satisfied by the invention.

While wearing the apparatus of the invention in its simplest phase as a load bearing belt only, for example during the incipient stages of a tactical operation, the user may suddenly need to have the ability quickly and securely to tie himself to a building or other anchor object. The load bearing belt 20, having as it does a quick-release type buckle 22 and for other reasons, is unacceptable as a component of a security or climbing harness. Under such urgent circumstances demanding the use of a safe harness, the user may then access the harness waistband 30.

Figure 11A:
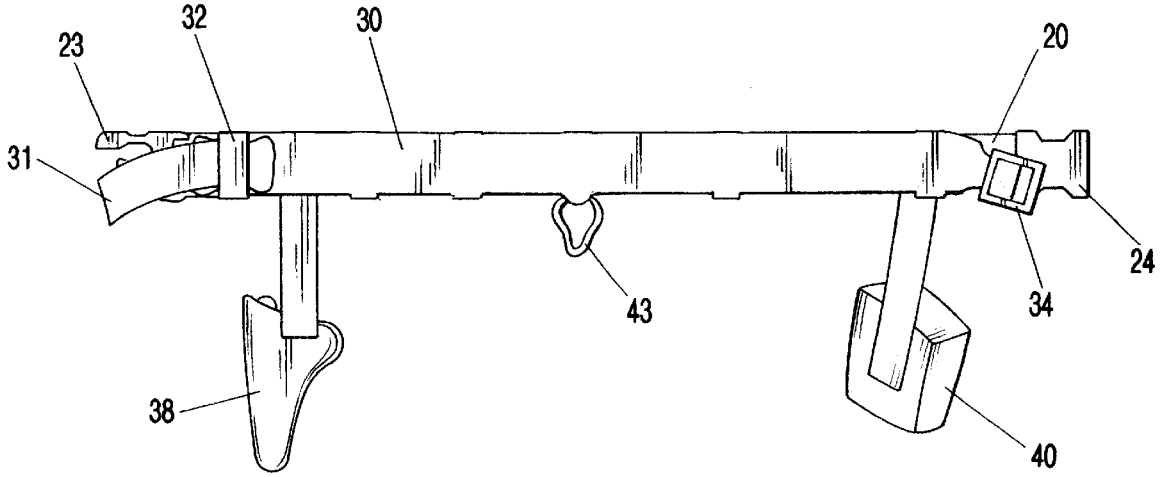
FIG. 11A is a front view of the apparatus of the invention, showing the load-bearing belt opened to permit the user access to the inner harness waistband for deployment.
Figure 11B:
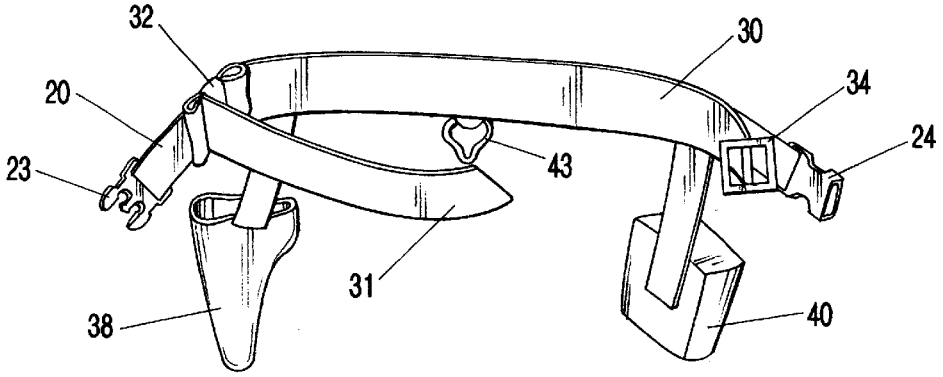
FIG. 11B is a front view later in time of the apparatus seen in FIG. 11A, showing the harness waistband being deployed for use to permit a simple "tie down" of the user.
Figure 11C:
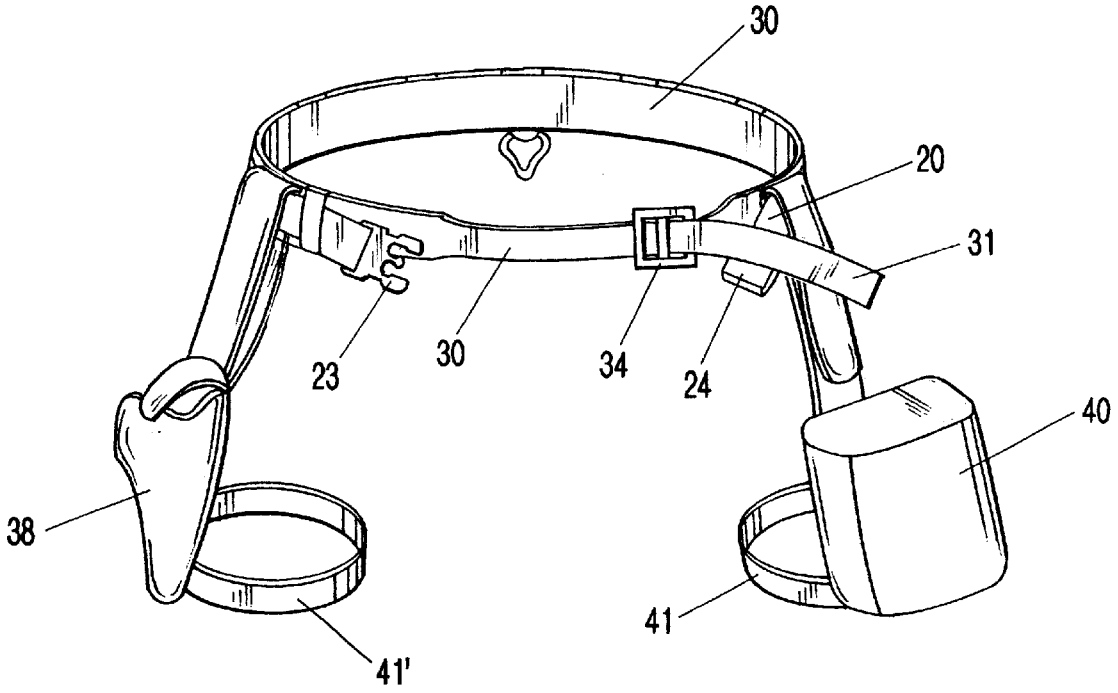
FIG. 11C is front view later in time of the apparatus seen in FIG. 11B, showing the harness waistband passed through and partially engaged with its buckle.
Figure 11D:
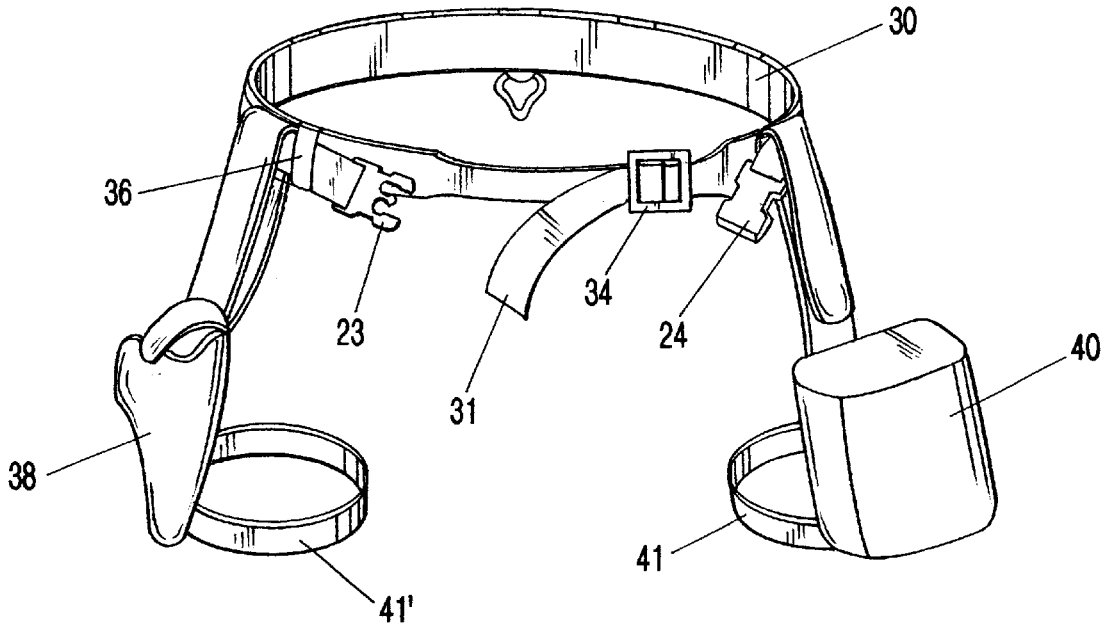
FIG. 11D is a front view later in time of the apparatus seen in FIG. 11B, showing the waistband secured by its buckle (i.e. to attach the waistband around a user's waist)

FIG. 11A shows how the user may quickly unbuckle the quick-clip buckle 22 of the load bearing belt 20, which provides immediate access to the working end 31 and climbing buckle 34 of the harness waistband 30. The user immediately seizes the working end 31 and climbing buckle 34 of the harness waistband 30 (which prevents the entire apparatus from falling to the ground). Referring to FIG. 11B, the user by quick tugs or pulls upon the working end 31 of the harness waistband 30 to dislodge it from its retained position within the releasable loop 32, and pulls the narrow working end to extend it out for use. The working end 31 is then passed through the climbing buckle 34, as seen in FIG. 11C, and then pulled through to adjust the harness waistband 30 to the desired tightness around the user's waist. The working end 31 is fully pulled through the climbing buckle 34, and the buckle 34 is locked in final engaged position as seen in FIG. 11D. As the climbing buckle 34 is an approved climbing-grade buckle, its final engagement may be relied upon to fix the waistband 30 in position during dangerous maneuvers.

Figure 11E:
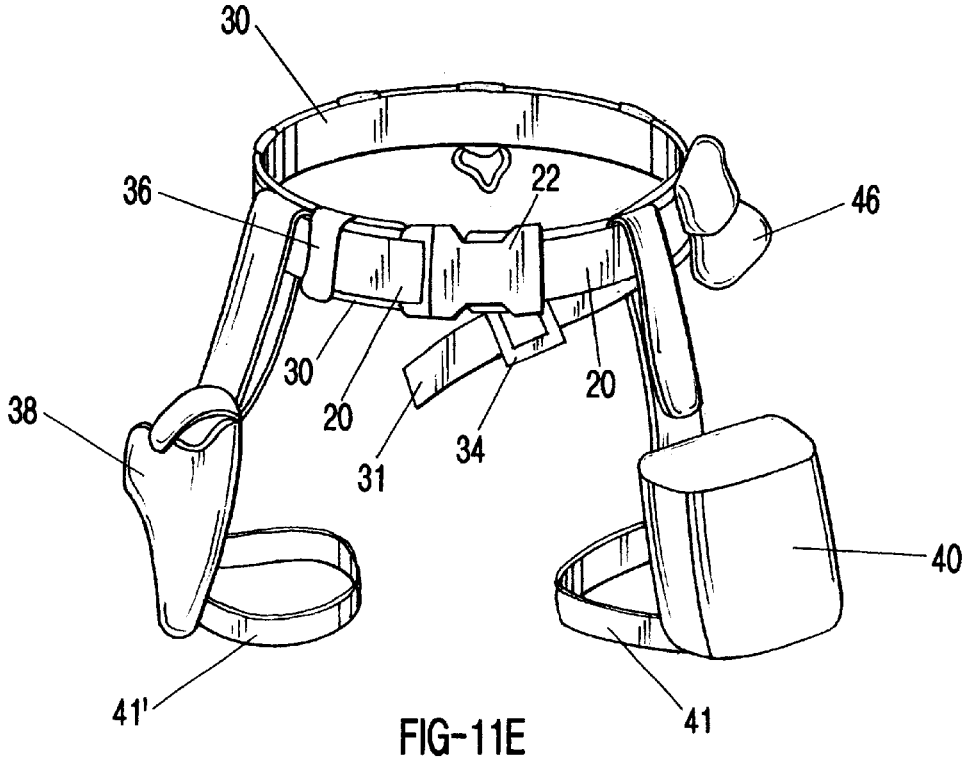
FIG. 11E is a front view later in time of the apparatus seen in FIG. 11D, showing the load-bearing belt closed and buckled on the outside of the harness waistband, so that the load-bearing belt and the harness may be used simultaneously.
Figure 11F:
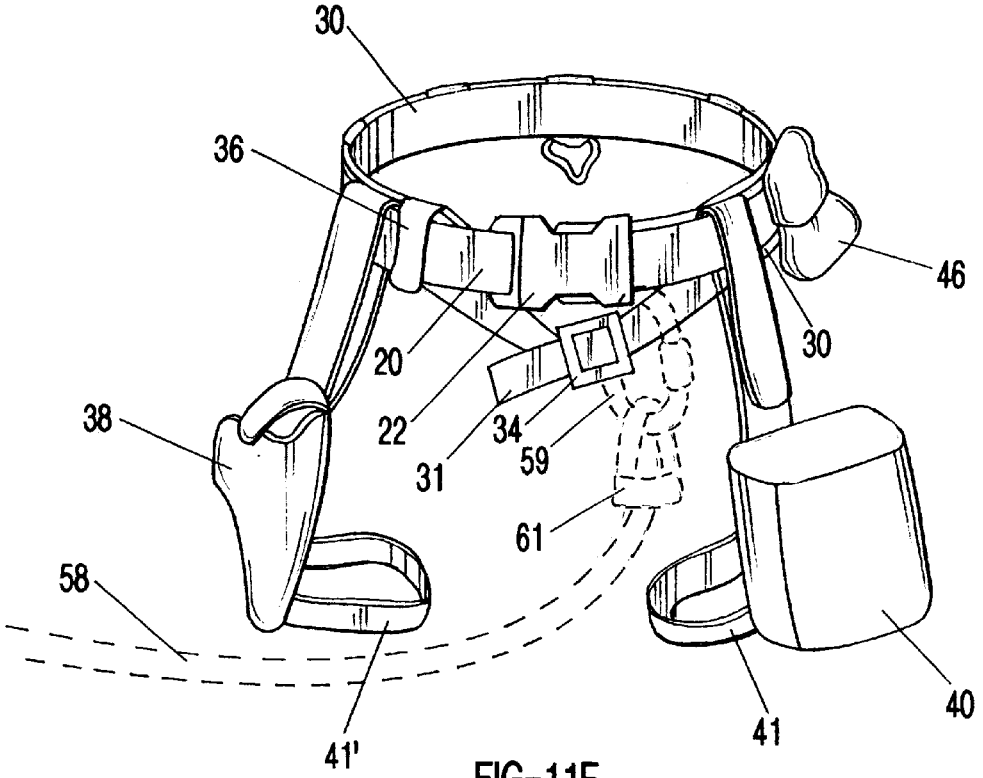
FIG. 11F is a front view later in time of the apparatus seen in FIG. 11E, showing a tie-down cord attached to an anchor point and connected to the harness waistband to provide a simple but reliable "tie down" of the user.

Once the waistband 30 is secured by means of its climbing buckle 34, the user can then re-connect the ends of the load bearing belt 20 together by means of the quick-clip buckle 22 as seen in FIG. 11E. As configured as depicted in FIG. 11E, the apparatus is ready for use as a secure means to accomplish a reliable tie-down. FIG. 11F shows how any type of tie-down cord 58 can be extended between the harness waistband 30 and a selected anchor point. Preferably, a climbing grade carabiner 59 is connected around the harness waistband 30; a quick-release or "pelican" type hook 61 is attached to the carabiner 59. The quick release hook 61 is used, with or without a line swivel 62 to attach the tie-down cord 58 to the carabiner and thus the waistband 30. The tie-down cord, clipped, tied, or otherwise securely attached to the anchor point, prevents the user from falling fatally from dangerous locations while performing any of a variety of tactical operations. Notably, the load bearing belt 20 is still in place, and the gear thereon remains readily accessible for use.

Figure 12A:
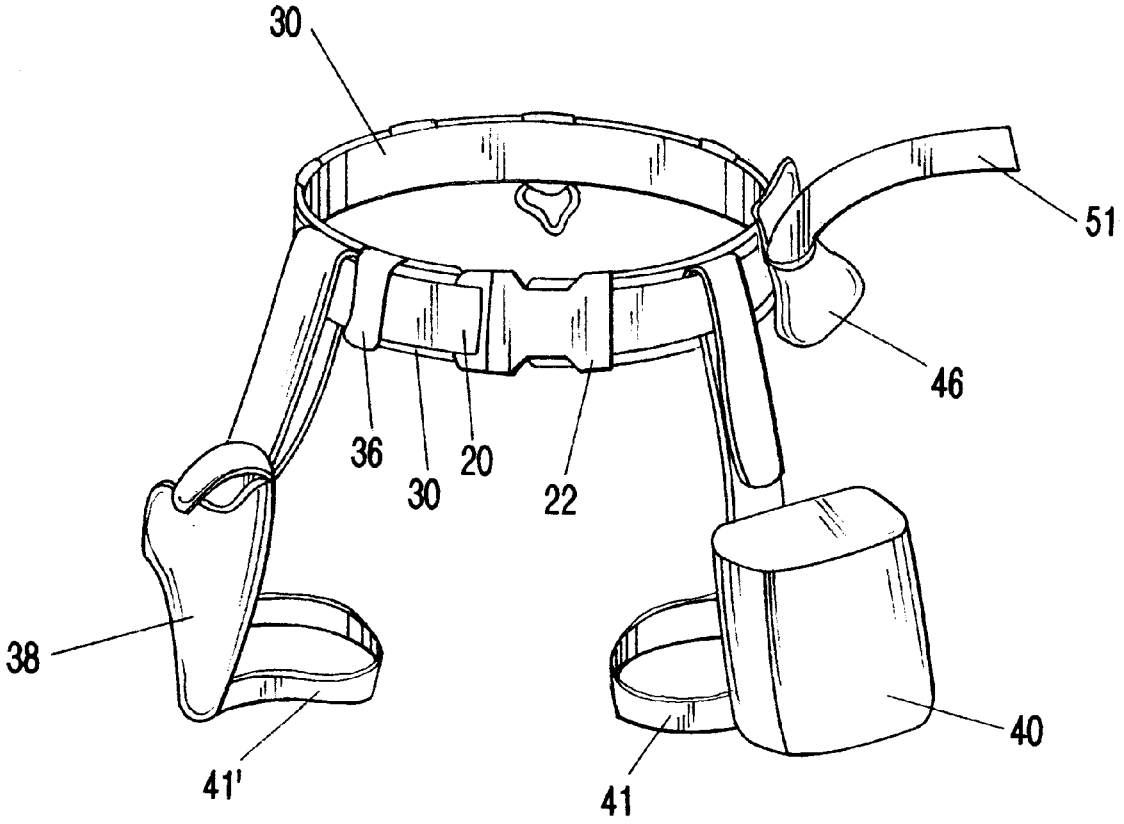
FIG. 12A is a front view of the apparatus of the invention, with the harness waistband deployed and secured beneath or inside the load bearing belt, and showing the incipient deployment of the harness leg loops from their storage pouch upon the load-bearing belt.
Figure 12B:
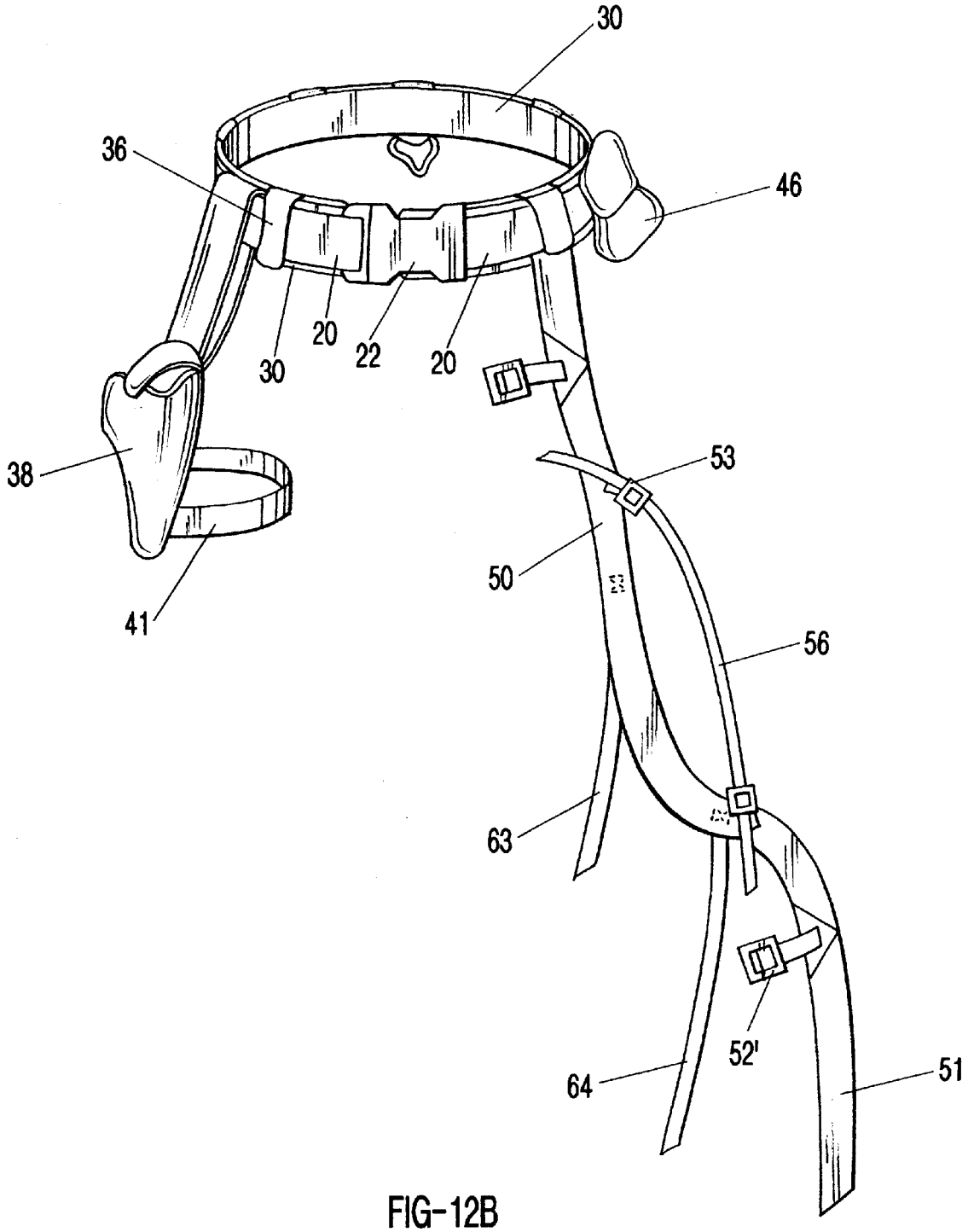
FIG. 12B is a front view later in time of the apparatus seen in FIG. 12 A, showing the leg loops fully removed from their storage pouch.

With his apparatus configured as seen in FIG. 11E or FIG. 11F, the user may realize the need quickly to have a complete climbing harness; for example, the demand may arise, while operating as a sniper, to rapidly but safely free-rappel from a bridge or the like, making a pelvis-girdling harness a necessity. The invention satisfies the user's need. The user simply opens the leg loop pouch 46 disposed upon the harness waistband 30 and over the load bearing belt 20, as seen in FIG. 12A. The leg loops 50, 51 are then quickly and easily pulled from their stored position in the pouch 46, as taught be combined reference to FIGS. 12A and 12B. Importantly and advantageously to the user, though, the leg loops 50, 51 are completely stowed in the pouch 46 until needed; they are not available to accidentally snag or hook on anything, and are protected from abrasion and the elements, until actually accessed for use—at which time they are quickly placed upon the user's body.

Figure 12C:
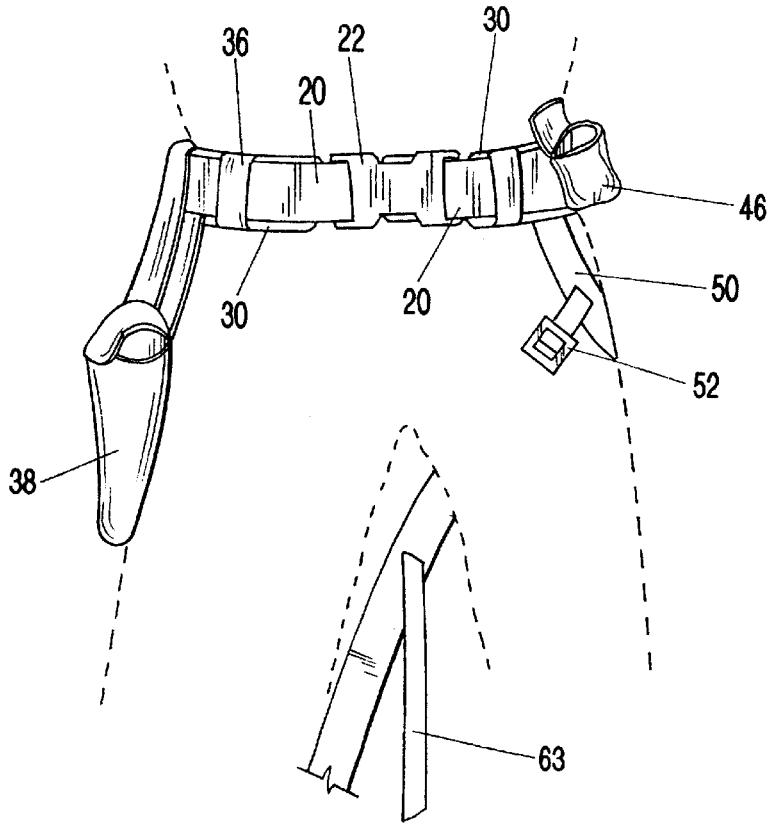
FIG. 12C is a front view later in time of the apparatus seen in FIG. 12B, showing the torso of a user and showing an initial step in the placement of the leg loops upon the user.
Figure 12D:
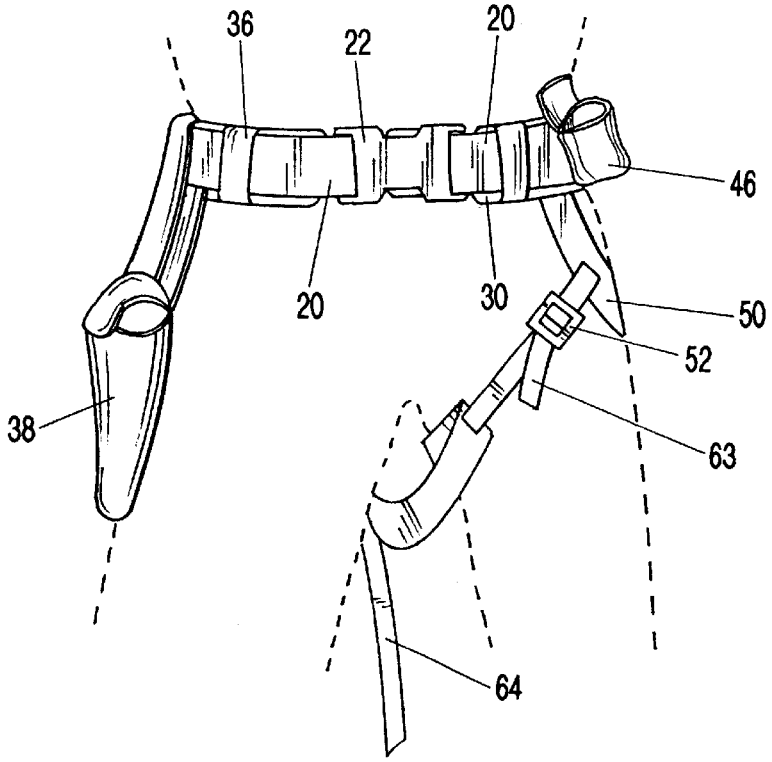
FIG. 12D is a front view later in time of the apparatus seen in FIG. 12C, showing a next step in the placement of the leg loops upon the user.
Figure 12E:
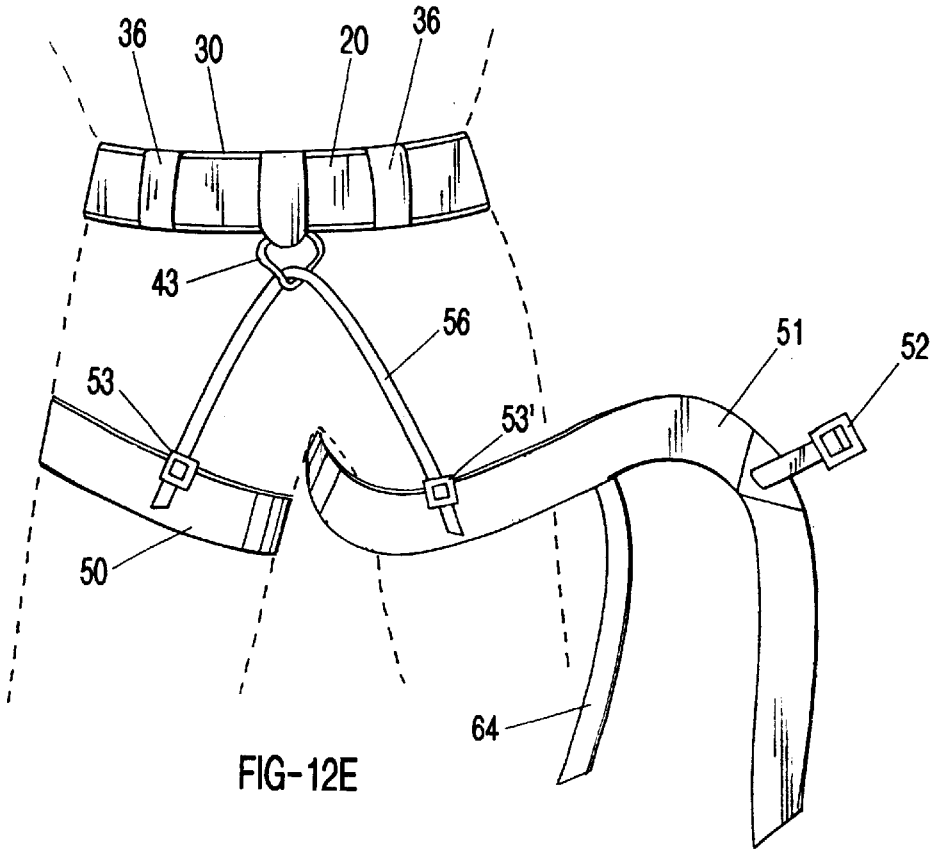
FIG. 12E is a rear view later in time of the apparatus seen in FIG. 12D, showing a third step in the placement of the leg loops upon the user.
Figure 12F:
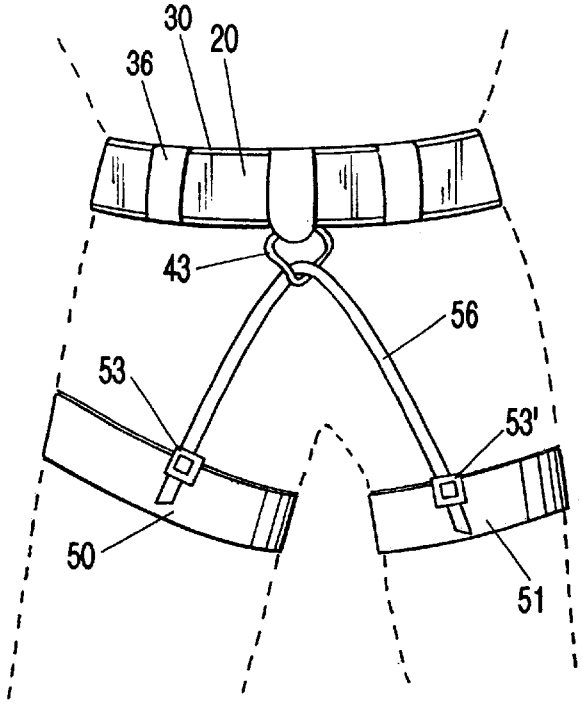
FIG. 12F is a rear view later in time of the apparatus seen in FIG. 12E, showing a fourth step in the placement of the leg loops upon the user.
Figure 12G:
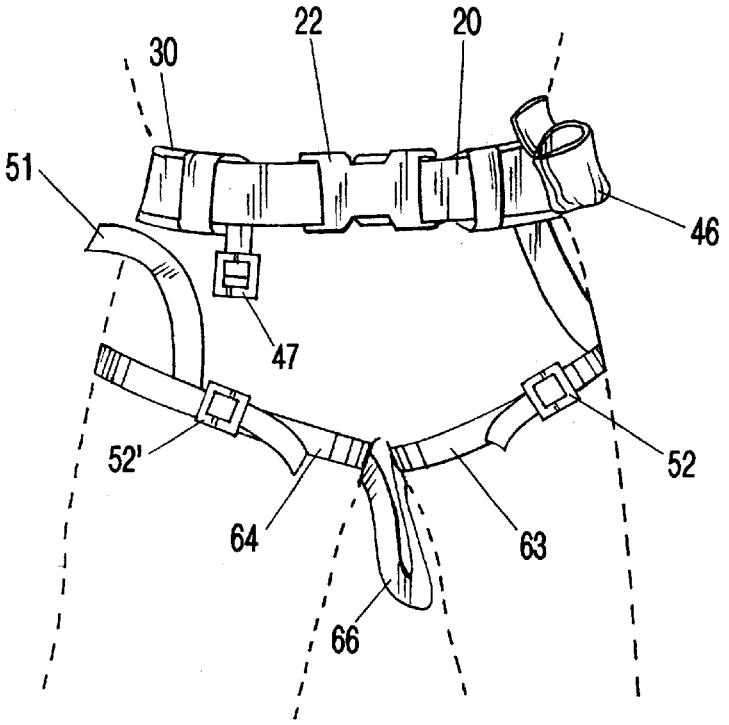
FIG. 12G is a front view later in time of the apparatus seen in FIG. 12F, showing a fifth step in the placement of the leg loops upon the user.
Figure 12H:
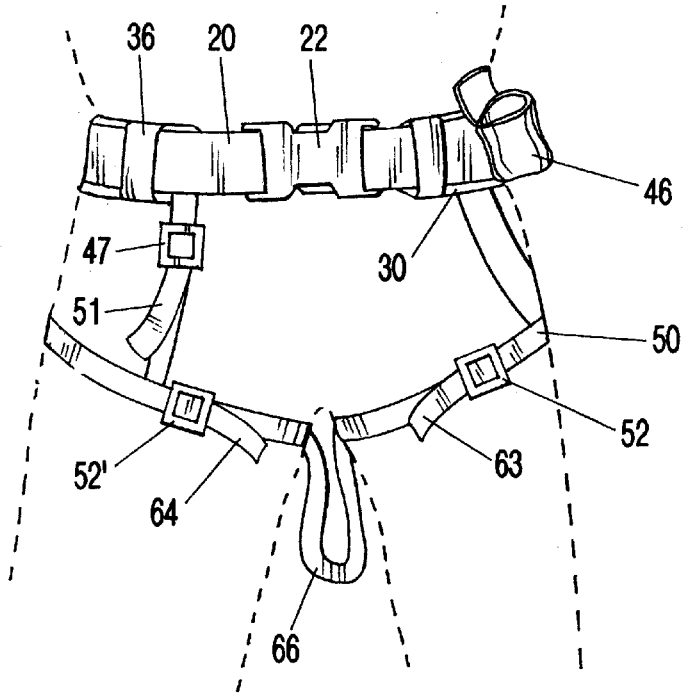
FIG. 12H is a front view later in time of the apparatus seen in FIG. 12G, showing a sixth step in the placement of the leg loops upon the user.
Figure 12I:
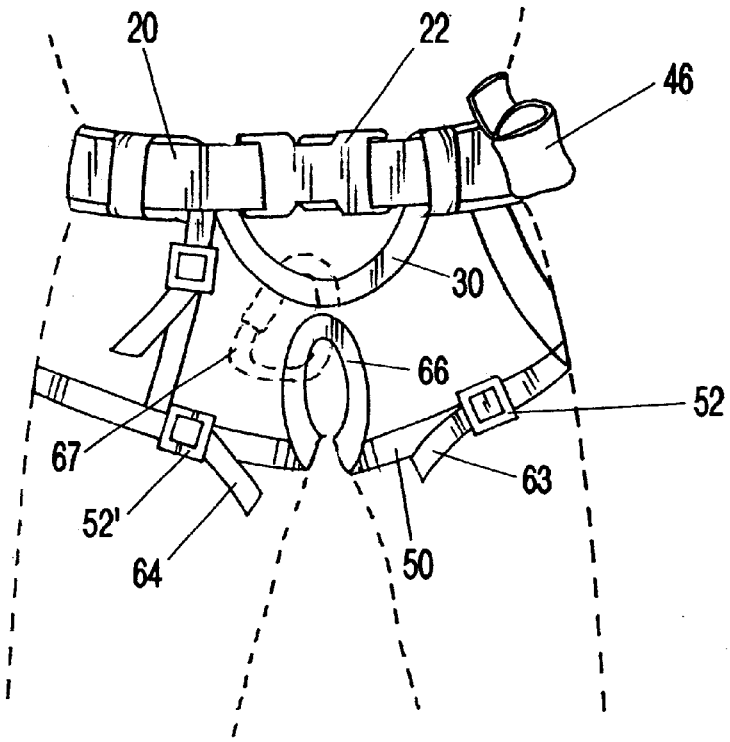
FIG. 12I is a front view later in time of the apparatus seen in FIG. 12H, showing a seventh step in the placement of the leg loops upon the user in which a carabiner is used further secure the leg loops tot crotch strap of the leg loops, creating a true climbing harness.

The placement of the leg loops 50, 51 upon the user is an activity easily understood and accomplished by one of ordinary skill in the art. Basic steps of the process are illustrated in FIGS. 12C–12J. FIG. 12C, a front view, shows that the first leg loop 50 is wrapped around the left thigh. The top first leg loop 50 is permanently sewn to the waistband 30 at point S, permitting the user to "feed" or "milk" the main strap of the loop 50 for placement against the leg; the left thigh strap 63 can then be brought up from between the legs and attached to the left inner leg loop buckle 52. Advantageously, since the leg loops 50, 51 are permanently attached to the waistband 30 at point S, the leg loops cannot be accidentally attached to the waistband in an undesirable twisted condition. The engagement of the left thigh strap 63 with the leg loop buckle 52 can then be adjusted to the requisite snug, secure, fit, and the buckle engaged to fix the loop in position, as seen in FIG. 12D. Referring to FIG. 12E, a rear view, it is seen that the auxiliary strap 56 is passed through the harness loop 43 at the back of the waistband 30, and adjustably connected and secured using either or both of the outer leg loop buckles 53, 53'. Continuing reference to FIG. 12E, the right leg loop 51 is then wrapped around the right thigh until the loop straps are snugly against the thighs immediately beneath the buttocks, as depicted in FIG. 12F. The right thigh loop 51 is wrapped around to the front of the thigh as seen in FIG. 12G, and the other inner loop buckle 52' is used to adjustably connect the other thigh strap 64 to the main strap of the loop 51. The end of the left loop 51 strap is then adjustably, comfortably but reliably attached to the waistband 30 by means of the leg loop attachment buckle 47, as illustrated in FIG. 12H. This leaves a crotch loop section 66 available, which is drawn up between the legs and clipped to the main harness waistband 30 using a carabiner 67; the complete, pelvic-girdling harness thus is standardly rigged and ready for use, and is seen in the front view of FIG. 12I. So rigged, the harness can be used to situate the user for rappelling or other tactical roping operations, as suggested by FIG. 12J. Advantageously, the adjustability of the circumferential size each of the leg loops 50, 51 by means of the leg loop buckles 52, 52', fosters versatility by allowing a user to use the apparatus with a variety of different pants (e.g. bulky winter pants versus light summer pants, or bulky biohazard suits, etc.).

Figure 12J:
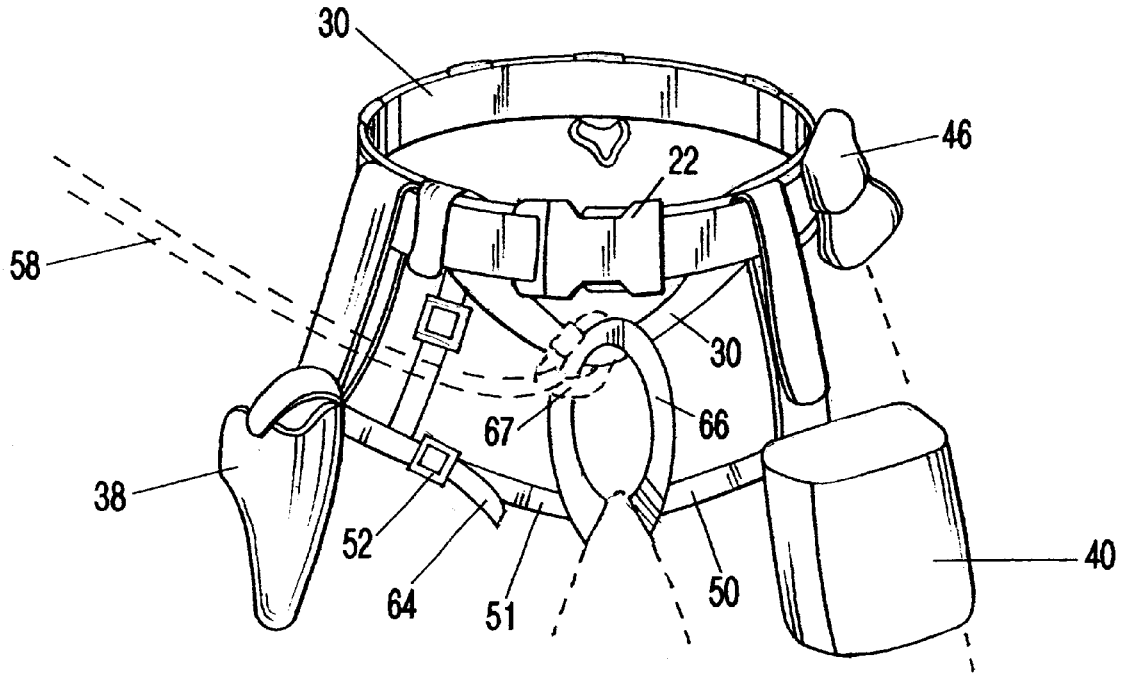
FIG. 12J is a front view later in time of the apparatus seen in FIG. 12I, showing the complete invention upon the torso of a user, with the load bearing belt and harness integrated and a personal tie-down strap connected to the fully deployed specialized harness.

In FIG. 12J, a quick-release hook is shown used to connect the crotch carabiner 67 to a climbing rope for use. Again, as viewed in FIG. 12J, the various gear and tools upon the load bearing belt 20 have remained available and accessible for use throughout the deployment and rigging of the leg loops 50, 51 of the harness.

One of the helpful components of the invention seen in FIG. 12J is the tactical thigh pouch 40. The tactical thigh pouch 40 permits the user of the invention easily to access a specialized tool or first aid kit during tactical operations. Various views of the tactical thigh pouch 40 are at FIGS. 13A–13G. An advantage of the tactical thigh pouch 40 is that it initially holds the items of a kit, e.g. a first aid kit, in a closed and secure manner, but then permits the user to open the pouch to access the contents and then close the pouch quickly in during rapid tactical operations.

Figure 13A:
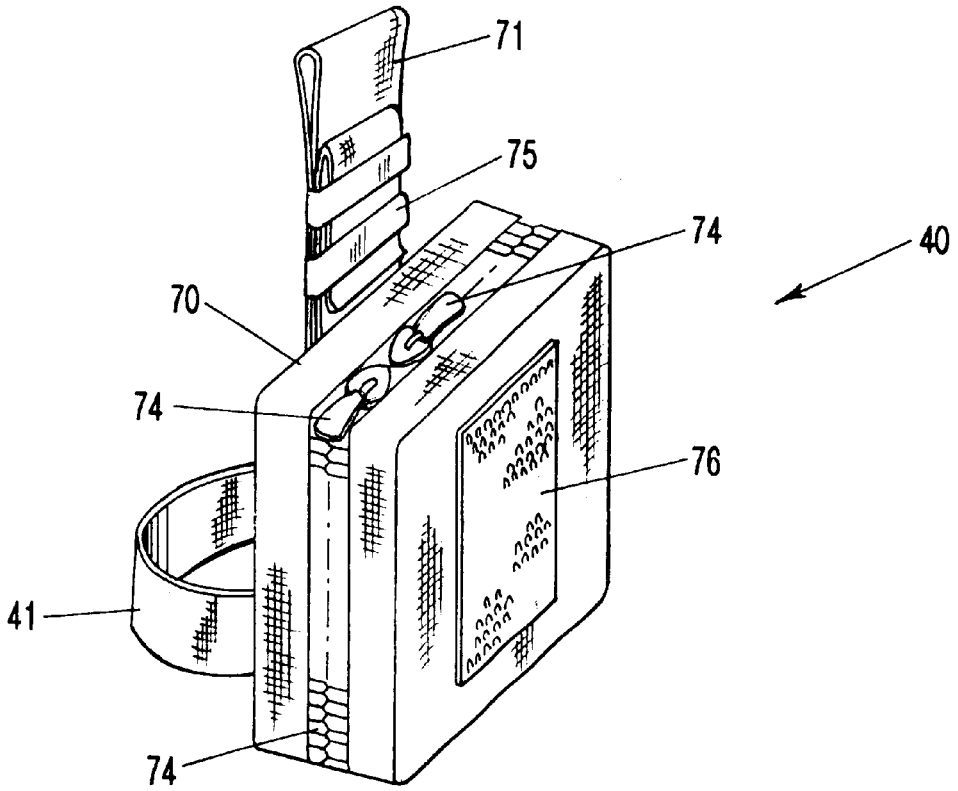
FIG. 13A is a perspective left side view of the tactical thigh pouch according to the present invention.
Figure 13B:
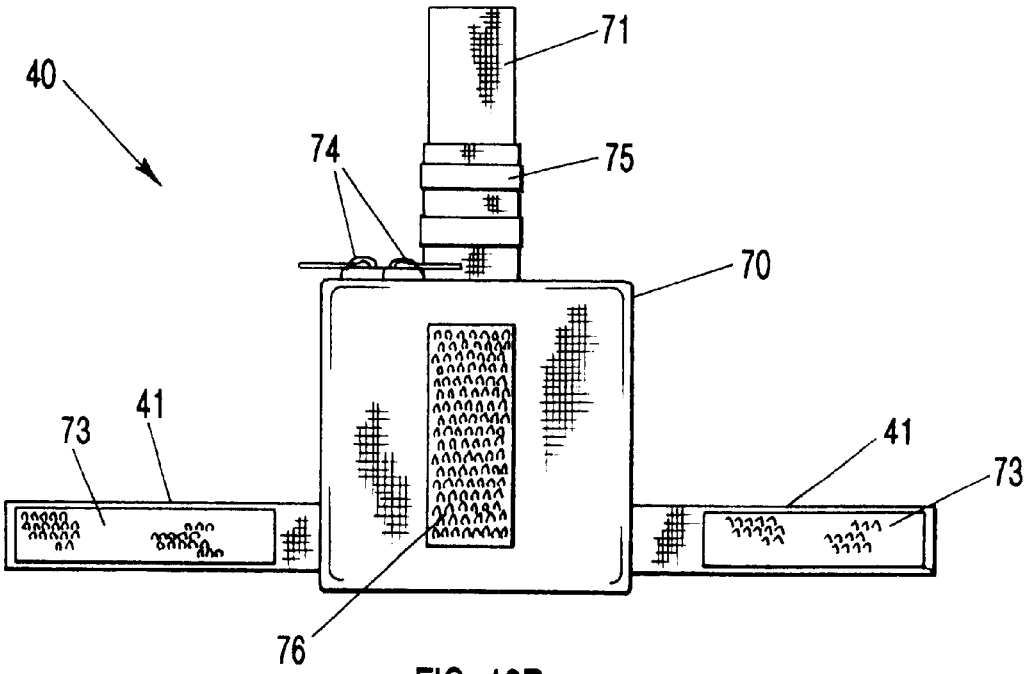
FIG. 13B is a front view of the tactical thigh pouch seen in FIG. 13A.

FIG. 13A shows that the pouch 40 includes a fabric container portion 70, thighstraps 41, and looped attachment strap 71. The container portion 70 holds the pouch contents, while the thigh straps 41 have sections having snaps or VELCRO fasteners 73 or the like (FIG. 13B) permitting the straps to be releasably connected into a loop around the user's upper thigh. The load bearing belt 20 is passed through the looped attachment strap 71 to suspend the tactical pouch 40 from the load bearing belt. The container portion 70 is bisected across its top and down its sides to permit access to its interior; the resulting opening is held closed by one or a pair of conventional (preferably nylon) zippers 74. Key elements of the tactical thigh pouch are the hook strap 75, and the strip of VELCRO fastener fabric 76 disposed upon the front, outward surface of the container portion 70. The hook strap 75 also has a VELCRO fastener strip thereon that is releasably engageable with a complementary VELCRO strip on the looped attachment strap 71. Accordingly, the hook strap 75 is engageable with the VELCRO strip on the attachment strap 71 in order to be stowed thereon when not in use. At later times, when the container portion 70 has been opened and yet needs to be closed quickly and/or quietly, the hook strap 75 may be engaged against the fastener fabric strip 76 to hold the pouch 40 closed in lieu of using the zippers 74 to close the container portion 70.

Figure 13C:
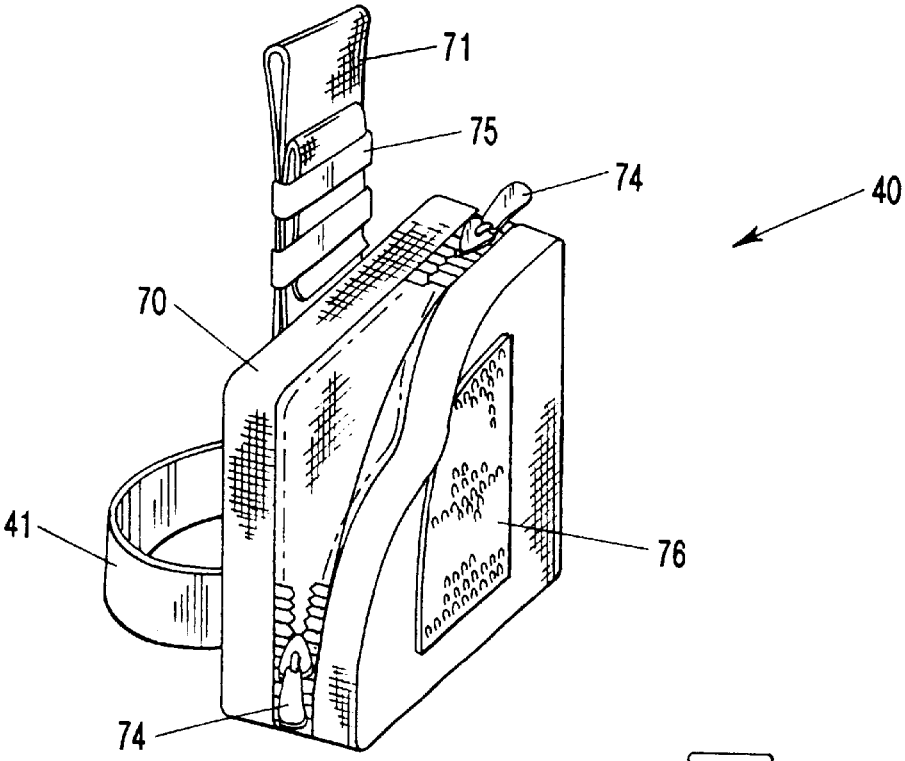
FIG. 13C is a perspective right side view of the tactical thigh pouch, showing it partially opened.

FIG. 13C depicts the pouch 40 as it is configured when suspended from the load bearing belt 20. Upon realizing a need to access the contents of the tactical pouch 40, the user unzips one or both the zippers 74, to initiate the opening of the container 70 to allow access to the interior thereof. This may occur, for example, during a hostage rescue paramedical situation while the load bearing belt 20 and the complete harness with waistband 30 and leg loops 50, 51 are in use. With the zippers 74 completely open, the front half of the container 70 is free to fall open and forward, with the bottom of the container serving as a sort of "living hinge" about which the front half of the container may pivot. With the front half pivoted into the fully open position, the tactical thigh pouch 40 assumes the configuration illustrated in FIG. 13D, in which the user has complete access to the contents of the container portion 70. Preferably and typically, the interior surfaces of the container portion are equipped with various elastic bands, interior pockets 77, 77' and the like for holding items in presentation position to be easily accessed by the user. For example, FIG. 13D shows a scissors 78 held in place for readily releasable access by a set of elastic bands.

Figure 13D:
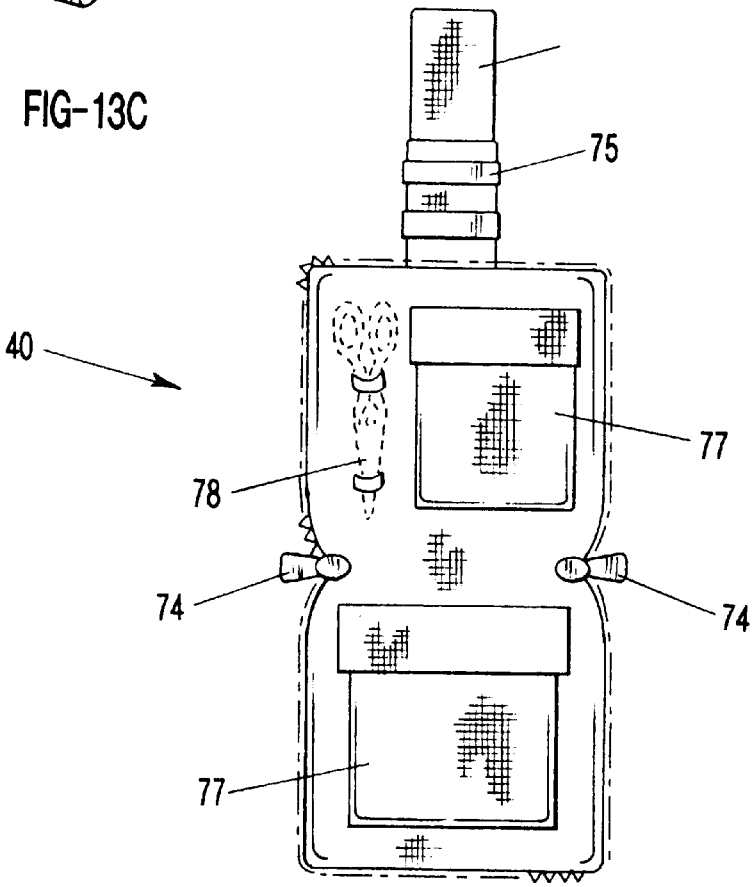
FIG. 13D is a front view of the tactical thigh pouch fully opened.
Figure 13E:
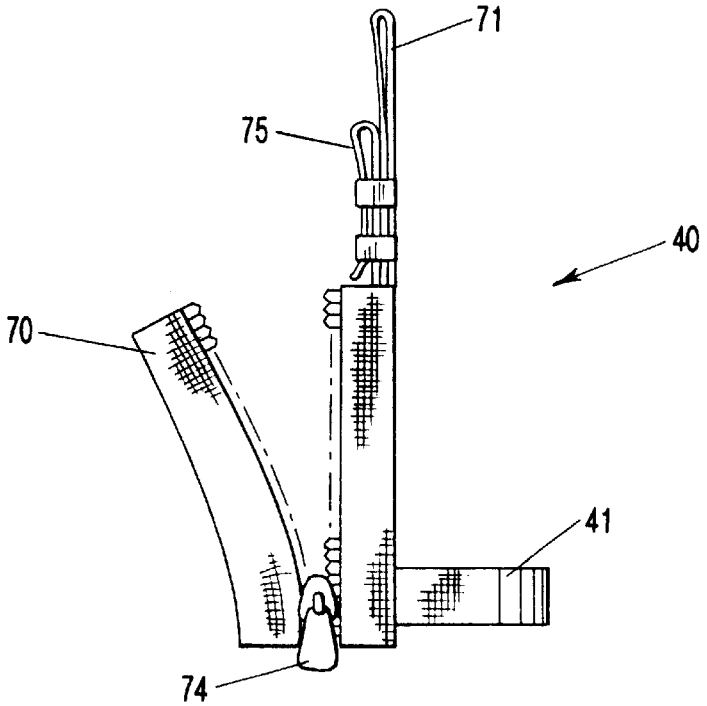
FIG. 13E is a right side view of the tactical thigh pouch partially opened.
Figure 13F:
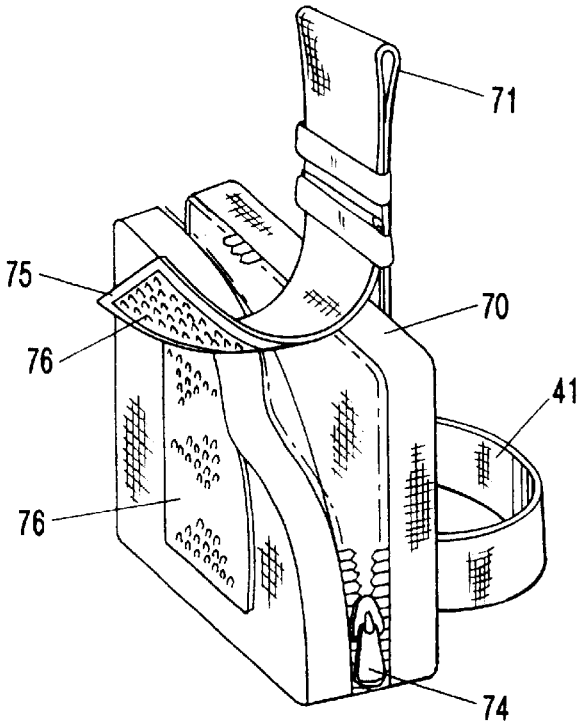
FIGS. 13F and 13G show the tactical thigh pouch in two stages of emergency rapid closure according to an advantage of the present invention.
Figure 13G:
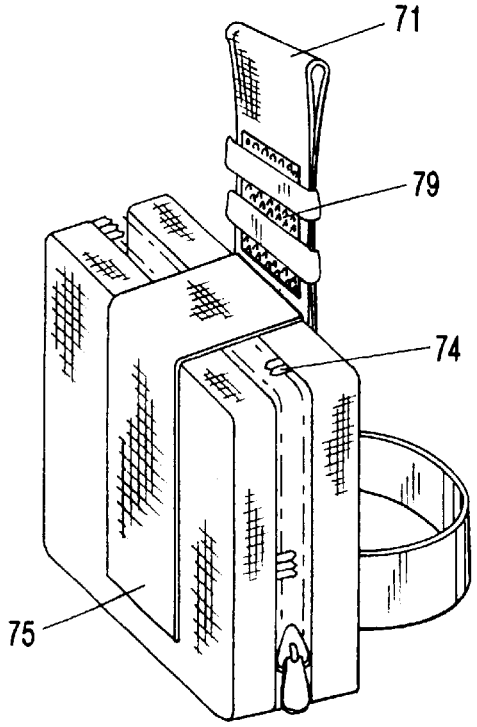

Occasionally the user will encounter circumstances, while the tactical pouch 40 is in the fully open position seen in FIG. 13D for use of the contents, when it is necessary to very rapidly close the pouch and, for example, change tactical location. In such situations, the front half of the container portion 70 can be pulled up and against the other half (FIG. 13E depicting a side view of the pouch in a mostly closed position) for closure. Rather than close the container 70 by means of the zippers 74, however—which may take too much time in emergency or hazardous situations, or difficult to accomplish in dark or precarious conditions—the user need merely pull the hook strap 75 from its stowed position upon the looped attachment strap 71, as suggested in FIG. 13F. Because the hook strap 75 is held in its stowed position merely by engagement between complementary strips of VELCRO brand fastener (one strip on the hook strap 75 and the complement on the looped attachment strap 71), the user can deploy the hook strap 75 from stowage with a single quick jerk (FIG. 13F). While holding the container portion 70 closed, the user may then secure it in the closed position by engaging the hook strap 75 with the VELCRO strip 76 on the front surface of the container 70 as shown in FIG. 13G. The container 70 portion of the pouch 40 thus is closed very quickly and reasonably reliably in an instant (while the zippers 74 are yet in open positions, as seen in FIG. 13G), permitting the user to change locations quickly before re-accessing the container portion by detaching the hook strap 75 from the VELCRO strip 76.

At the conclusion of a mission, the entire apparatus of the invention is easily removed. The leg loops 50, 51 of the harness are removed by proceeding in reverse order through the steps taken to rig them upon the person. The leg loops 50, 51 are then re-stowed into the leg loop pouch 46, and that pouch 46 closed as by a zipper or the like. The entire apparatus can be removed from the person by unbuckling the quick-clip buckle 22 of the load bearing belt 20, and the climbing buckle 34 of the harness waistband 30. The waistband 30 and the load bearing belt 20 need not be disconnected from one another; rather, they may be handled and stored as a unit, held together by the connecting loops 36, 36', 36".

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

I claim:

1. In combination with a load bearing belt upon which various equipment may be disposed, a climbing harness comprising:

a harness waistband having leg loops attached thereto, said waistband having an outside surface and an inside surface, said inside surface disposable toward the user's body;

a plurality of connecting loops upon said waistband, said connecting loops movable between an open position to permit said load bearing belt to be disposed in parallel contact with said outside surface of said waistband and a closed position around said load bearing belt in contact with said outside surface; and fasteners upon said connecting loops whereby said connecting loops are fastened in the closed position thereby to maintaining waistband and said load bearing belt in generally parallel contact during use;

wherein said harness waistband is movable between a stowed position and a use position, and further comprising a releasable loop connected to a first end of said waistband and holding said first end of said waistband in a folded condition folded back on itself on said inside surface adjacent to said load bearing belt when said waistband is in the stowed position, and further comprising a climbing buckle upon a second end of said waistband, wherein said first and an said second end of said waistband are connected together with said climbing buckle when said waistband is in the use position.

2. An apparatus according to claim 1, wherein said harness further comprises:

a leg loop pouch attached to said waistband;

wherein said leg loops are movable between a stowed position completely within said leg loop pouch and a deployed position completely outside said leg loop pouch.

3. A combination load bearing belt and climbing harness apparatus, said apparatus comprising:

a climbing harness waistband having leg loops attached thereto, said waistband having an outside surface and an inside surface, said inside surface disposable toward the user's body;

a load bearing belt upon which items may be temporarily carried, said load bearing belt disposed in parallel contact with said outside surface of said climbing harness waistband; and a plurality of connecting loops disposed upon said climbing harness waistband and movable between an open position and a closed position said connecting loops having fasteners thereon to permit said connecting loops to be fastened in the closed position; wherein said connecting loops are movable to the open position to permit the load bearing belt to be placed in parallel contact with said outside surface of said climbing harness waistband, and in the closed position said loops extend around said load bearing belt temporarily securing together as a unit said load bearing belt and said climbing harness waistband parallel contact with each other;

and further wherein said harness waistband is movable between a stowed position and a use position, and further comprising a releasable loop said waistband and holding said first end of said waistband in a folded condition folded back on itself on said inside surface adjacent to said load bearing belt when said waistband is in the stowed position, and further comprising a climbing buckle upon a second end of said waistband, wherein said first and an said second end of said waistband are connected together with said climbing buckle when said waistband is in the use position.

4. An apparatus according to claim 3 wherein said load bearing belt further comprises a quick-release buckle with which said load bearing buckle may be secured about a user's waist.

5. An apparatus according to claim 3, further comprising a tactical thigh pouch removably attachable to said load bearing belt, said tactical thigh pouch comprising;

a pouch container, said container comprising a front portion and a back portion, said portions separable to place said container in an open position to permit access to the interior of said container;

fasteners for releasably fastening together said front and back portions of said container in a closed position;

a looped attachment strap upon said container for removably attaching said container to said load bearing belt;

a hook strap stowable upon said looped attachment strap; complementary fasteners upon said hook strap and upon said front portion of said container, wherein said container may be maintained in the closed position by deploying said hook strap from said looped attachment strap and engaging said complementary fasteners.

6. An apparatus according to claim 3 further comprising a buckle for securing said load bearing belt about a user's waist, wherein said harness waistband is movable between a deployed use position and a stowed position while said buckle is engaged to secure said load bearing belt about a user's waist.

7. An apparatus according to claim 6 wherein said harness waistband is disposable in the use position, with said first end connected to said second end by means of said climbing buckle, while said load bearing belt is secured about a user's waist.

8. An apparatus according to claim 7, wherein said harness further comprises:

a leg loop pouch attached to said waistband;

wherein said leg loops are movable between a stowed position completely within said leg loop pouch and a deployed position completely outside said leg loop pouch.

* * * * *